US007802340B2

(12) United States Patent
Knopow et al.

(10) Patent No.: US 7,802,340 B2
(45) Date of Patent: Sep. 28, 2010

(54) EXTENDABLE CLEANING IMPLEMENT HAVING TWO SUPPORT HEADS

(75) Inventors: Jeremy F. Knopow, Burlington, WI (US); Rob Martineau, Chippewa Falls, WI (US); David A. Hoadley, Racine, WI (US); Lawrence J. Fenske, Madison, WI (US); Yan Gracindo, Surrey (GB); Craig F. Shiesley, Surrey (GB); Paul Simpson, Surrey (GB); Benn Beagan Miller, Cambridge (GB); Milt Erickson, Merrillan, WI (US); Scott A. Olson, Chippewa Falls, WI (US); Micah L. Maraia, Menomonie, WI (US); Christopher Peterson, Chippewa Falls, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1191 days.

(21) Appl. No.: 11/384,953

(22) Filed: Mar. 20, 2006

(65) Prior Publication Data

US 2006/0288508 A1 Dec. 28, 2006

Related U.S. Application Data

(63) Continuation-in-part of application No. 11/240,991, filed on Sep. 30, 2005, which is a continuation-in-part of application No. 11/011,404, filed on Dec. 14, 2004, now abandoned, and a continuation-in-part of application No. 11/124,527, filed on May 6, 2005.

(51) Int. Cl.
*A47L 13/10* (2006.01)

(52) U.S. Cl. ..... 15/144.1; 15/144.4; 15/229.8

(58) Field of Classification Search ..... 15/144.4, 15/144.1, 229.6, 229.8, 228, 247.2, 47.21
See application file for complete search history.

(56) References Cited

U.S. PATENT DOCUMENTS

| | | | | |
|---|---|---|---|---|
| 942,490 | A | 12/1909 | Dunn | |
| 1,007,512 | A | 10/1911 | Aardahl | |
| 1,557,473 | A | 10/1925 | Cross | |
| 2,165,967 | A | 7/1939 | Haupt | |
| 2,319,992 | A | 5/1943 | Hubbard | |
| 2,824,328 | A * | 2/1958 | Bedford | 15/230.11 |
| 2,898,586 | A | 8/1959 | Beck | |
| 2,982,586 | A | 5/1961 | Gkuebe | |
| 2,984,852 | A | 5/1961 | George | |
| 3,362,037 | A | 1/1968 | Griffin | |

(Continued)

FOREIGN PATENT DOCUMENTS

EP 1 523 919 A1 4/2005

(Continued)

*Primary Examiner*—Shay L Karls

(57) ABSTRACT

A cleaning tool 410 designed to be used with at least one cleaning implement/replaceable dusting sleeve/cleaning mitt or cleaning pad 11 is disclosed. The cleaning tool 410 includes a telescoping support 409 comprised of a plurality of telescopingly received shafts or sections (412, 413, 414, 415) wherein one of the shafts is an I-beam 415. The shafts 412, 413, 414 and 415 may be freely extended into a locked fully extended position 401 and released via depression of a first engaging projection 439. A primary support head 416 and secondary support head 418 are pivotally mounted to a forward mount 440 and releasably locked together.

18 Claims, 29 Drawing Sheets

U.S. PATENT DOCUMENTS

| | | | |
|---|---|---|---|
| 3,474,833 | A | 10/1969 | Garrette, Jr. et al. |
| 3,860,350 | A | 1/1975 | Rogers |
| 3,886,618 | A | 6/1975 | Paoletti |
| 3,911,521 | A | 10/1975 | Franchot |
| 4,054,313 | A | 10/1977 | Ciuci |
| 4,079,978 | A | 3/1978 | McMullin |
| 4,325,157 | A | 4/1982 | Balint et al. |
| 4,345,351 | A | 8/1982 | Moss et al. |
| 4,396,028 | A | 8/1983 | Waggoner |
| 4,524,484 | A | 6/1985 | Graham |
| 4,653,142 | A | 3/1987 | Upton |
| 4,793,646 | A | 12/1988 | Michaud, Jr. |
| 5,336,012 | A | 8/1994 | Newville |
| 5,343,587 | A | 9/1994 | Findley |
| 5,387,048 | A | 2/1995 | Kuo |
| 5,442,831 | A | 8/1995 | Yamada |
| 5,515,574 | A | 5/1996 | Larson |
| 5,530,981 | A | 7/1996 | Chen |
| 5,593,196 | A | 1/1997 | Baum et al. |
| 5,692,855 | A | 12/1997 | Burton |
| 5,799,357 | A | 9/1998 | Taylor |
| 5,807,007 | A | 9/1998 | Stemper |
| 5,926,896 | A | 7/1999 | Allemann et al. |
| 5,940,933 | A | 8/1999 | Chang |
| 5,943,727 | A | 8/1999 | Freer |
| 6,213,672 | B1 | 4/2001 | Varga |
| 6,631,368 | B1 | 11/2001 | Sartori |
| 6,371,686 | B1 | 4/2002 | Wu |
| 6,415,470 | B1 | 7/2002 | Ramrattan |
| 6,523,213 | B1 | 2/2003 | Post |
| 6,540,424 | B1 | 4/2003 | Hall et al. |
| 6,551,001 | B2 | 4/2003 | Aberegg et al. |
| 6,854,912 | B2 | 2/2005 | Dyer et al. |
| 7,004,671 | B2 | 2/2006 | Tawara et al. |
| 2005/0097691 | A1 | 5/2005 | Tsuchiya et al. |
| 2005/0257345 | A1 | 11/2005 | Mitchell et al. |
| 2005/0102781 | A1 | 12/2005 | Tsuchiya et al. |
| 2006/0048325 | A1 | 3/2006 | Tsuchiya |

FOREIGN PATENT DOCUMENTS

| | | | |
|---|---|---|---|
| EP | 1 523 920 | A1 | 4/2005 |
| WO | WO02/34101 | | 5/2002 |
| WO | WO02/065887 | | 8/2002 |
| WO | WO02/102221 | | 12/2002 |
| WO | WO2004/008935 | | 1/2004 |
| WO | WO2004/017806 | | 3/2004 |

* cited by examiner 225
239
259
260
212
209
242
235
265
229
245
263
336
218
216
274
240

225
212
209
232
231
229
213
245
247
214
249
263
264
216
215
266
336
218
274
240

225
212
209
216
232
229
231
245
247
263
264
336
218
274
240

EXTENDABLE CLEANING IMPLEMENT HAVING TWO SUPPORT HEADS

CROSS-REFERENCE TO RELATED APPLICATIONS

This application is a continuation-in-part of U.S. patent application Ser. No. 11/240,991 filed Sep. 30, 2005 which is a continuation-in-part of U.S. patent application Ser. Nos. 11/011,404, filed Dec. 14, 2004 now abandoned, and Ser. No. 11/124,527 filed May 6, 2005 the entireties of which are incorporated by reference herein.

BACKGROUND OF THE INVENTION

1. Field of the Invention

The present invention relates to cleaning devices in general. More particularly, it relates to devices of this type having a replaceable-cleaning-implement, preferably an extendable handle, and an adjustable support head having multiple heads for mounting cleaning implements relative to the handle at various angles.

2. Discussion of the Related Art

It is well known to clean dust and dirt from floors, furniture, or other room surfaces by rubbing a dust rag against the surface, such that the dust and dirt adhere to the cloth. Sometimes, this cleaning is facilitated by wetting the rag with water, a polish, or other liquid. Such cloths or strips have on occasion also been mounted on a head of a cleaning implement, which in turn is affixed to an elongated handle, to thereby create a floor dust mop. Alternatively, the handle has been formed somewhat shorter so that the resulting structure functions as a hand duster (e.g. one used to clean dust from Venetian blinds and other structures that are closer to the person cleaning them).

There have also been efforts to make dusting heads that are used with such handles of a material that retains dust even without being wetted with a polish or other liquid, where the head is nevertheless still so inexpensive that it can be used for a short period of time until soiled and then disposed of. This is in some applications an improvement over having materials having such great structural integrity (and therefore often cost) that they are used for prolonged purposes or washed between uses.

In other developments, to render a single dusting device more suitable for both floor/ceiling dusting and close-in furniture dusting, some such dusting devices have been designed with a telescoping handle which can be shortened when furniture dusting is desired, and can be elongated when floor or ceiling dusting is desired.

Recently, there has also been an attempt to provide adjustability between the angle of the duster head relative to the angle of the handle axis. However, this prior design used a strong locking device as part of the angle adjuster, such that adjustment of the handle angle typically required two hands to achieve, with the consumer's hand needing to come near to the portion of the device where the soiled dusting heads were positioned when an adjustment was to be made.

A need still exists for improved adjustable holder for cleaning implements. There is a particular need for an easy to use all-in-one duster with a telescoping handle that can be extended to clean floors and collapsed to clean furniture and appliances. While improvements have been made in the adjustability of the angle of the duster head relative to the handle, these improvements have been directed to a cleaning device with a single dusting head. There remains a need for a cleaning system that includes dual dusting heads that can be operated independent of one another to accommodate alternative dusting or cleaning tasks.

SUMMARY AND OBJECTS OF THE INVENTION

Consistent with the foregoing, and in accordance with the invention as embodied and broadly described herein, a cleaning tool, a holding device, and a method of cleaning are disclosed in suitable detail to enable one of ordinary skill in the art to make and use the invention.

In a first embodiment, a cleaning tool includes a telescopic support having at least two separate shafts, of which a hollow first shaft is configured to slidably receive a second ribbed shaft within the first shaft. A pivot member receiving cavity is attached to the second shaft and configured to receive a primary support and a secondary support. The primary support and the secondary support are configured to receive at least one cleaning pad.

In another embodiment, the first shaft may include a slotted wall at a forward end to receive the second ribbed shaft. For example, the second shaft may be an I-beam. The secondary support may be releasably locked to the pivot member receiving cavity and the primary support may be releasable locked to the secondary support. For example, the secondary support may include at least one engagement tab configured to releasably engage grooves on a cog located on the primary support and the secondary support may be releasably locked to the pivot member receiving cavity by an engagement tab configured to engage notches on the secondary support.

In still another embodiment, the at least two separate shafts are releasably locked together by at least one spring loaded engaging projection extending from the second shaft into a slot on the first shaft. The at least two separate shafts may comprise a grip, a first extension piece, a second extension piece and a shank slidably received within one another. The grip may define a hollow space configured to receive the first extension piece, the first extension piece may define a hollow space configured to receive the second extension piece and the second extension piece may define a hollow space configured to receive the shank. The grip, first extension piece, second extension piece and shank preferably freely slide into a locked, fully extended position. The grip, first extension piece, second extension piece and shank may also be collapsed from the locked, fully extended position by the depression of a single engaging projection. At least one alignment tab may extend along an outside surface of first extension piece and be received in a slot in the grip. At least one alignment tab may extend along an outside surface of second extension piece and be configured to be received in a slot in the first extension piece.

In an alternative embodiment, a holding device includes a telescopic support that includes a plurality of slidable shafts and a forward mount attached to one of the plurality of shafts. The forward mount is configured to receive a primary support and a secondary support and the primary and secondary supports are configured to retain at least one cleaning pad. The primary and secondary supports may be releasably locked together in a variety of orientations and the secondary support may be releasably locked to the forward mount. In one embodiment, the primary support can be rotated at least 225 degrees in relation to the telescopic support. The primary support may be locked into a 45 degree, 90 degree, 135 degree, 180 degree, 225 degree and 270 degree position in relation to the telescopic support. The secondary support can be rotated at least 180 degrees in relation to the telescopic support.

In another embodiment, an engagement tab is attached to the forward mount and configured to releasably engage notches in the secondary support. In still another embodiment, the forward mount is attached to a ribbed shaped shaft such as an I-beam and at least one of the plurality of shafts includes flanges configured to slidably receive the I-beam.

In a final embodiment, a method of cleaning using a holding device that includes a plurality of telescoping shafts having a forward mount attached to one of the plurality of shafts, the forward mount supporting a primary and secondary cleaning pad support includes rotating a primary support from a first locked position locked to the secondary support to a desired cleaning position, placing a cleaning pad on the primary cleaning pad support and moving the cleaning pad across a surface to be cleaned. The method may further include the steps of moving the primary support to a position 180 degrees from the secondary support, releasing a secondary support from a locked position, and placing a cleaning pad on the secondary support.

Because the support heads can be positioned/temporarily fixed at varying angles with respect to each other, they provide the opportunity for increased cleaning effectiveness. For example, the top of a dresser can be dusted at the same time that a side of the dresser is being dusted when such a device is provided.

Embodiments of the present invention therefore achieve many of the desired functionalities found in existing dusters (e.g. capability of replacing the cleaning head after a single use; a single product which can dust mop a floor or furniture; a dust mop capable of angular adjustment relative to the main handle; relatively low production and assembly costs). However, they also achieve other desirable functionalities in various embodiments.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
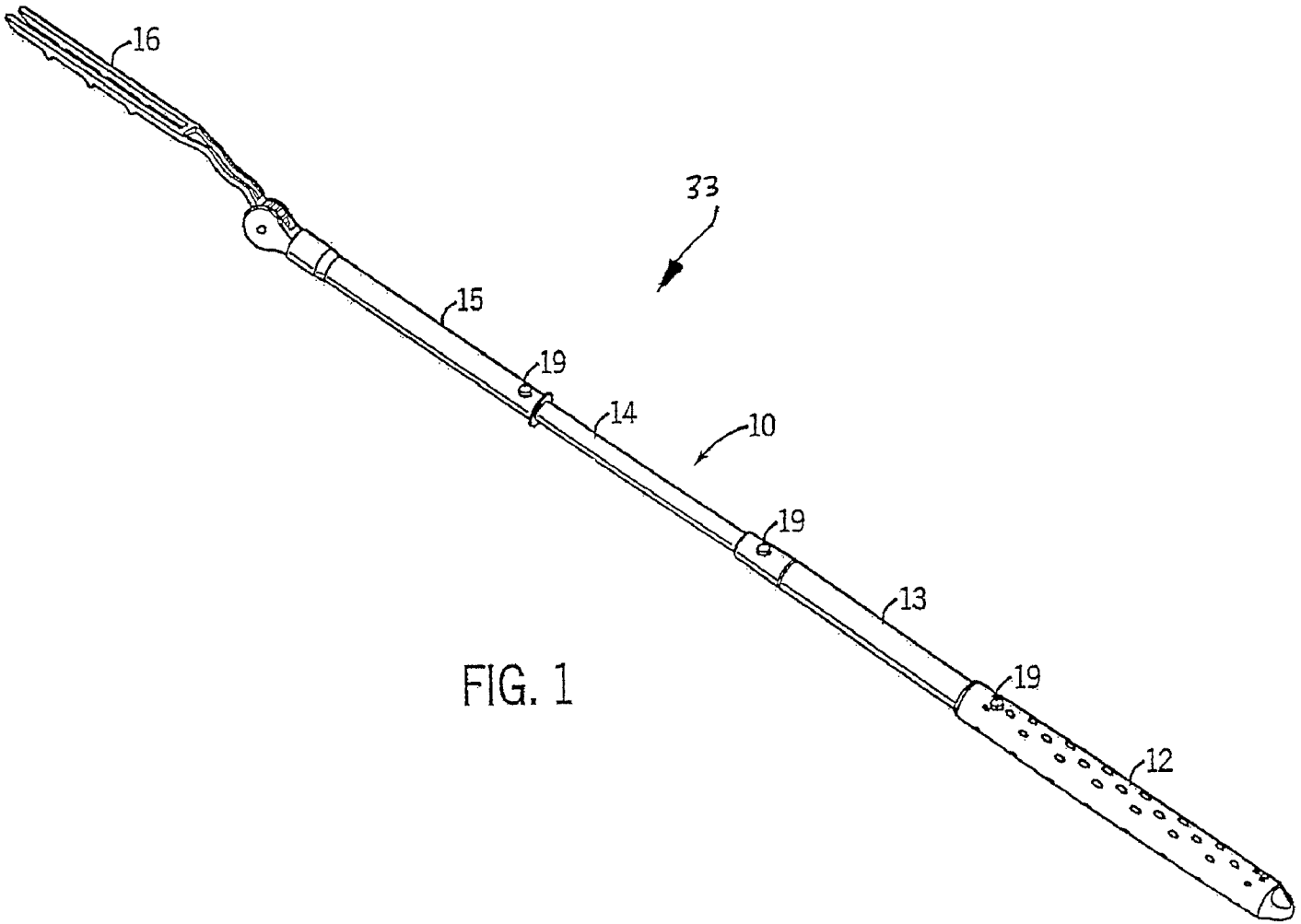
FIG. 1 is a right, upper, rear, perspective view of an assembled cleaning implement holder of the present invention shown in an elongated configuration.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENTS

The present invention and the various features and advantageous details thereof are explained more fully with reference to the non-limiting embodiments described in detail in the following description.

1. System Overview

In a basic form, the invention is a cleaning and/or dusting tool that includes a telescoping support comprised of a plurality of telescopingly received shafts or sections that support a forward mount. The shafts may be freely extended into a locked fully extended position and released via depression of a single engaging projection. A primary support head and secondary support head are pivotally mounted to the forward mount on a single gear and releasably locked together. The cleaning tool allows for a large degree of extension for the dusting of ceilings and floors, while at the same time providing for a device that can be easily collapsed for the dusting of easier to reach surfaces. The dusting device further provides for cleaning support heads capable of supporting multiple cleaning pads, thereby increasing the surface area of the cleaning surface and the ease of cleaning or dusting large surfaces such as floors and ceilings.

2. Detailed Description of Preferred Embodiments

Figure 2:
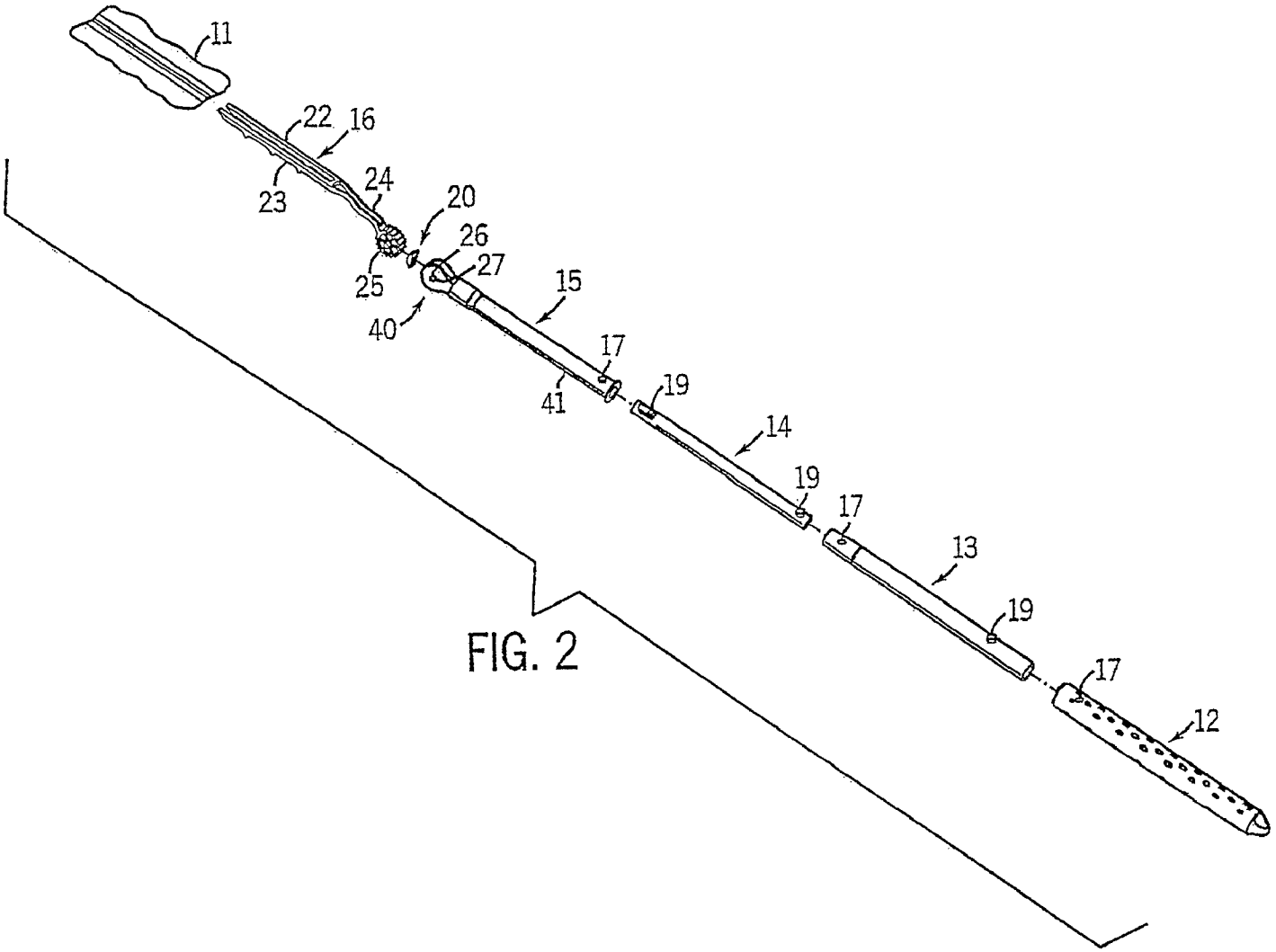
FIG. 2 is a view similar to FIG. 1, but with parts exploded from each other, and with an associated cleaning mitt shown adjacent thereto.

As best seen in FIGS. 1 and 2, the inventive cleaning system 33 preferably includes a holder 10 designed to be used with a cleaning implement/replaceable dusting sleeve/cleaning mitt or cleaning pad 11. The holder has a grip 12, telescoping handle extension pieces 13 and 14, shank 15 and support head 16. There is also a resilient catch 20.

In this preferred form, various radially extending bumps or protrusions 19 are formed on some of these parts which fit into corresponding catch holes 17 on adjacent parts. While not shown in detail, these bumps 19 are preferred to be positioned on flexible tabs which can deflect radially inwardly as the tubular parts are assembled to one another, and then flex radially outwardly into the holes 17 to temporarily fix the tubular parts in the FIG. 1 position.

One can then press the bump 19 of extension part 13 radially inward to permit extension part 13 to telescope into a hollow of handle grip 12. Similarly, the bump 19 on the rear end of extension part 14 can be pressed radially inward to permit extension part 14 to telescope into a hollow of tubular extension part 13. Another possibility is for bump 19 at the forward end of extension part 14 to be pressed radially inward to permit extension part 14 to alternatively telescope into a hollow of shank 15.

This creates a handle out of parts 12, 13, 14 and 15 which can be at its greatest length as shown in FIG. 1, or can be configured in a smaller length for use in closer in applications, or perhaps shipment or storage. Of course, the present invention can preferably be practiced regardless of whether the handle can telescope at all, or what the particular linkage is between the parts of the handle, or whether the handle is formed from multiple parts or one part.

Figure 6:
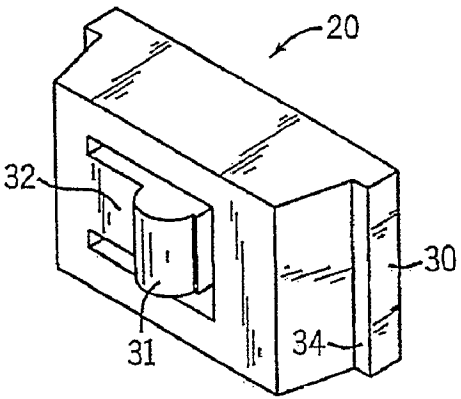
FIG. 6 is an enlarged perspective view of a catch in accordance with the present invention.

As best seen in FIG. 2, the support head 16 preferably has a forked end 22 with tines 23 supported by a linking section 24, which connects to a lug/wheel 25. The catch 20 is best appreciated by reviewing FIG. 6. It has a base 30 on which is mounted an interfering projection 31 linked by a flexible arm/root 32 to the base 30. Pressure on the projection 31 will cause it to deflect rearwardly. In the absence of pressure it will flex back to its FIG. 6 position.

Figure 4:
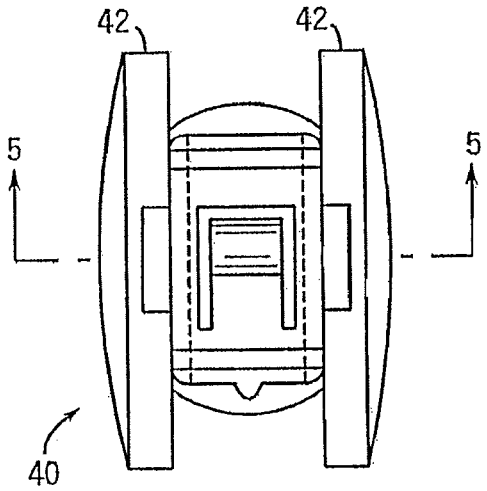
FIG. 4 is an elevational view taken along plane 4-4 of FIG. 3.
Figure 5:
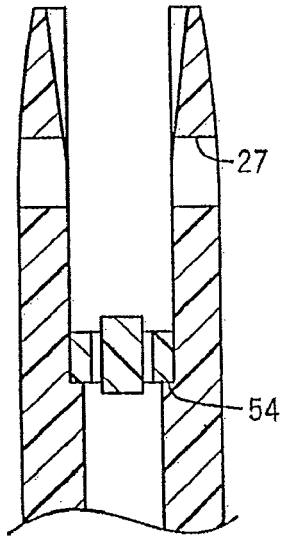
FIG. 5 is a sectional view taken along line 5-5 of FIG. 4.

As best seen in FIGS. 2 and 4, the shank 15 has an upper handle section 41 and a forward mount 40 having two spaced ears 42.

The wheel 25 preferably has outer integral axles 26 on its opposed lateral sides. The ears 42 of the shank 15 can flex outward from each other when the wheel 25 is pushed there between. The ears have corresponding holes 27 into which the axles 26 then snap, thereby creating a pivot joint. This permits about 270 degrees of rotational movement of the support 16 relative to the longitudinal axis of the handle 12/13/14/15.

Figure 3:
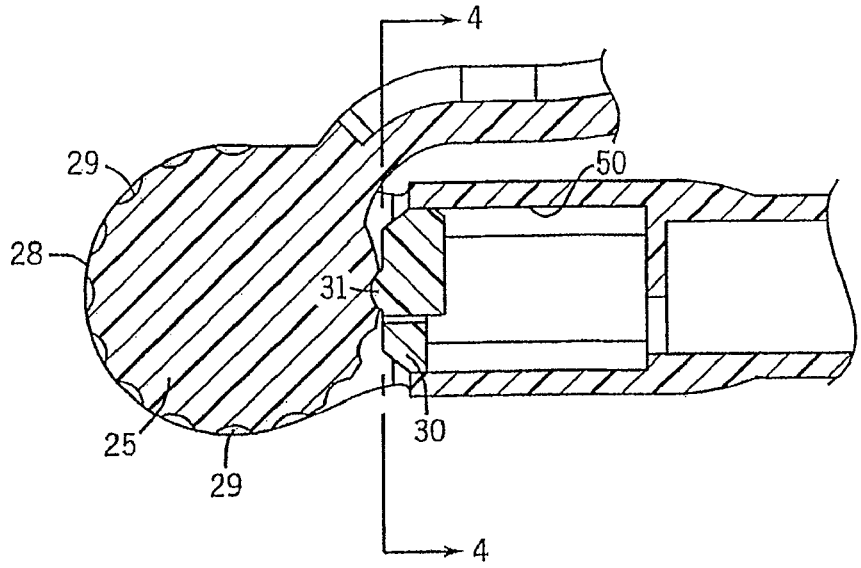
FIG. 3 is a partial vertical cross sectional view taken along the FIG. 1 longitudinal axis, albeit when the support head has already been repositioned to about the 2 o'clock position, rather than the 9 o'clock position shown in FIG. 1.

As best seen in FIG. 3 the catch 20 can be mounted in a recess 50 in the forward end of the shank 15. Walls 34 rest on corresponding ledges 54 inside the recess 50. When the support head 16 has its wheel 25 assembled into the ears 42 as shown in FIG. 1, FIG. 3 shows how the resulting internal assembly will operate. It should be noted that the wheel 25 has a series of shallow dished pockets 29, of a generally parabolic nature, arrayed around its periphery, to create an almost sprocket-like appearance. The projection 31 has a corresponding shape which fits into a selected one of the pockets at a time.

As torque is applied to the support head 16, it starts to rotate on the axis formed by axles 26. The radially outward sections 28 on the wheel 25 abut against the projection 31, causing it to deflect rearward, removing the interference of the projection, and permitting rotation to the next pocket 29. The pockets 29 and projection 31, as well as the tension on the biasing means/resilient arm/root 32, are such that if a consumer holds the handle grip 12 and pushes the support head 16 with an intention to adjust the support head angle relative to the handle longitudinal axis, the angle will be repositioned to another stable fixed position, without the need for the consumer to place a hand on or near the support head 16. Yet, the typical torque experienced during dusting or drying a surface will not be sufficient to cause the angular adjustment.

In highly preferred forms, the catch 20 is molded from a flexible plastic such as acetyl or nylon, and the support head 16 is molded from a more rigid plastic such as ABS or a polycarbonate/ABS blend. The flexibility of the biased projection 31 is such that a torque of at least 0.25 Newton meters (preferably 0.3-1.4 Newton meters, even more preferably 0.7-0.9 Newton meters) applied to the support head in a plane parallel to the handle 12/13/14/15 will not cause angular adjustment of the support head 16 relative to the longitudinal axis of the handle 12/13/14/15, although additional torque will, without causing a destruction of a portion of the device.

Figure 7:
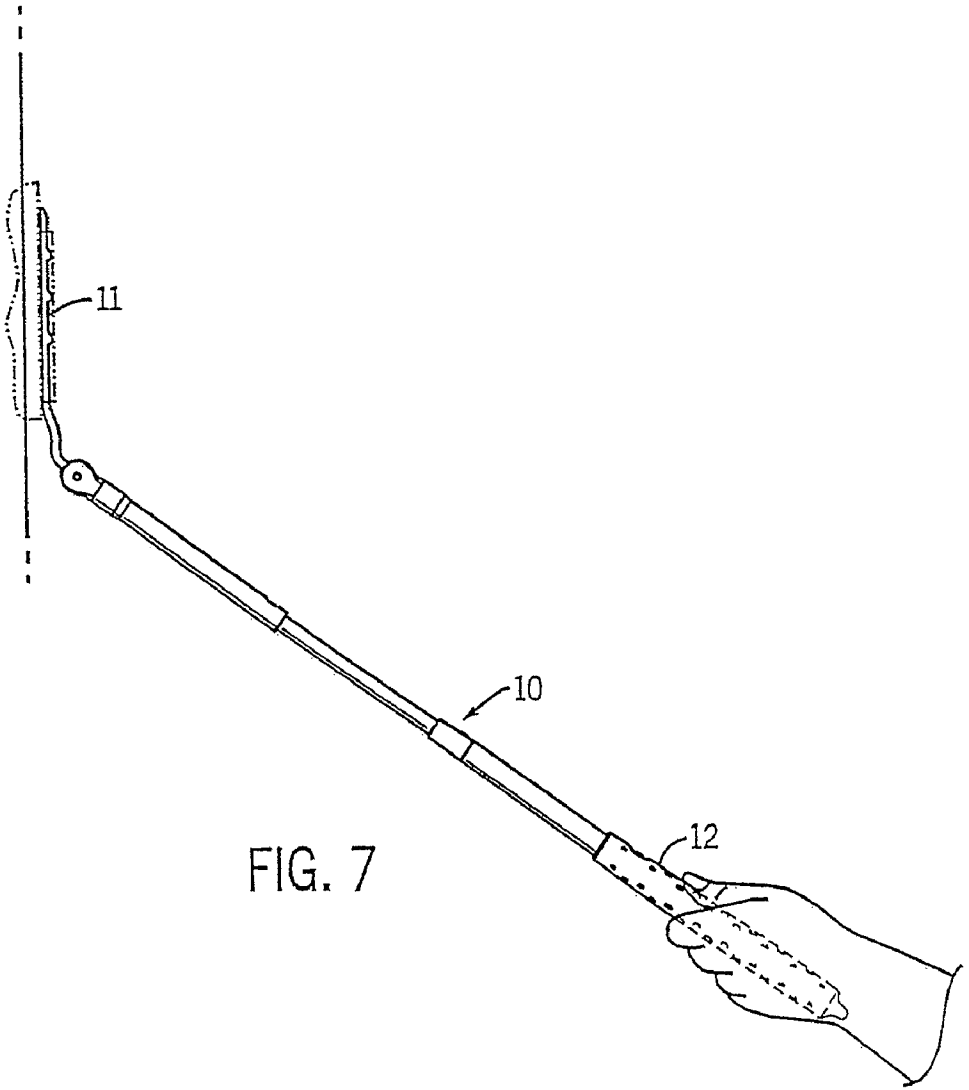
FIG. 7 is a schematic view of how the support head can be positioned to dust a floor.

Hence, when the device is held by the handle grip 12 as shown in FIG. 7, and begins in the FIG. 1 position, pressing the forward end of a tine or multiple tines 23 of the support head 16 against a vertical wall with sufficient force can cause the device to adjust to the FIG. 7 stable position. However, lighter force, such as would typically be applied during dusting, will not cause the angular position to be adjusted.

Figure 8:
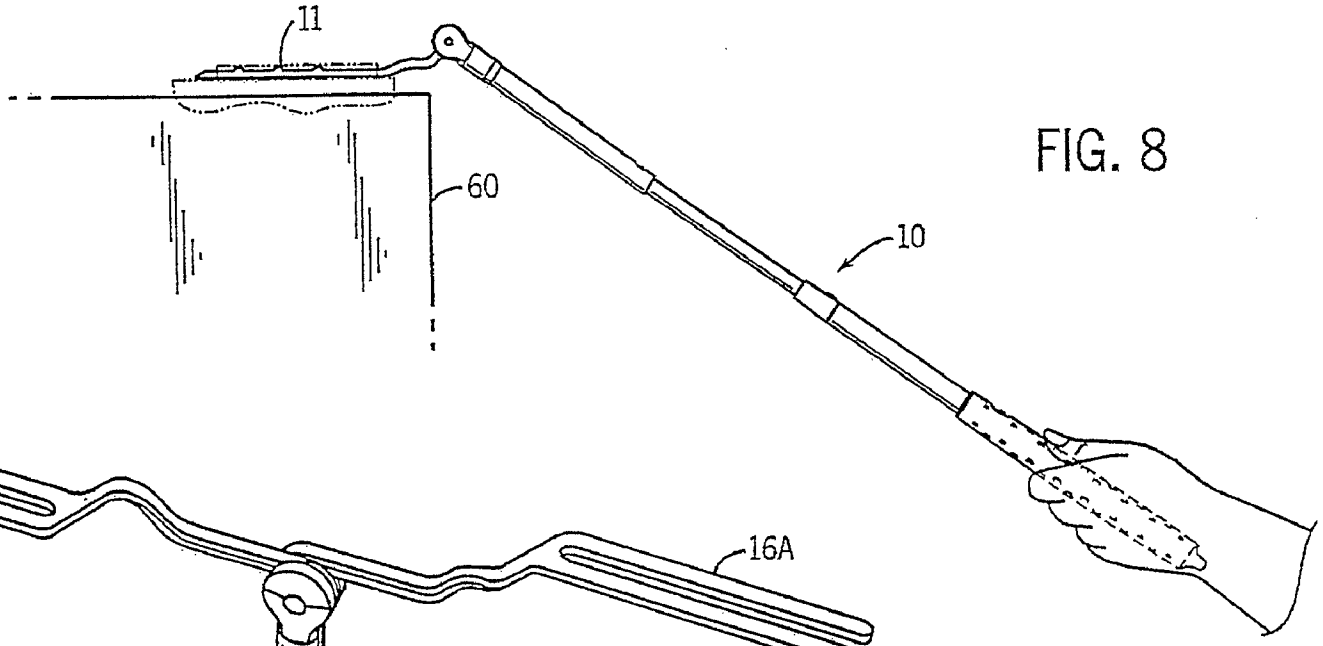
FIG. 8 is a schematic view of how the support head can be repositioned to dust the top of a cabinet.

Thereafter, the angular position can be readjusted in a similar manner, depending on the object being cleaned. For example, the angle can be adjusted to that shown in FIG. 8 to permit dusting of the top of a tall furniture cabinet 60, or other items such as the top of ceiling fan blades (not shown).

Once dusting of an area has been completed, one can remove the replaceable dusting sleeve 11 and replace it with another. In between uses, the device can be compactly stored as the support head 16 can be rotated to the FIG. 3 position, and the handle parts can be telescoped together. For purposes of shipment, the device can be shipped in a compact package in disassembled form, yet can be quickly assembled by a consumer without complex instructions. However, it is preferred that the shank 15, catch 20, and support head 16 be pre-assembled at the factory prior to shipment.

Figure 9:
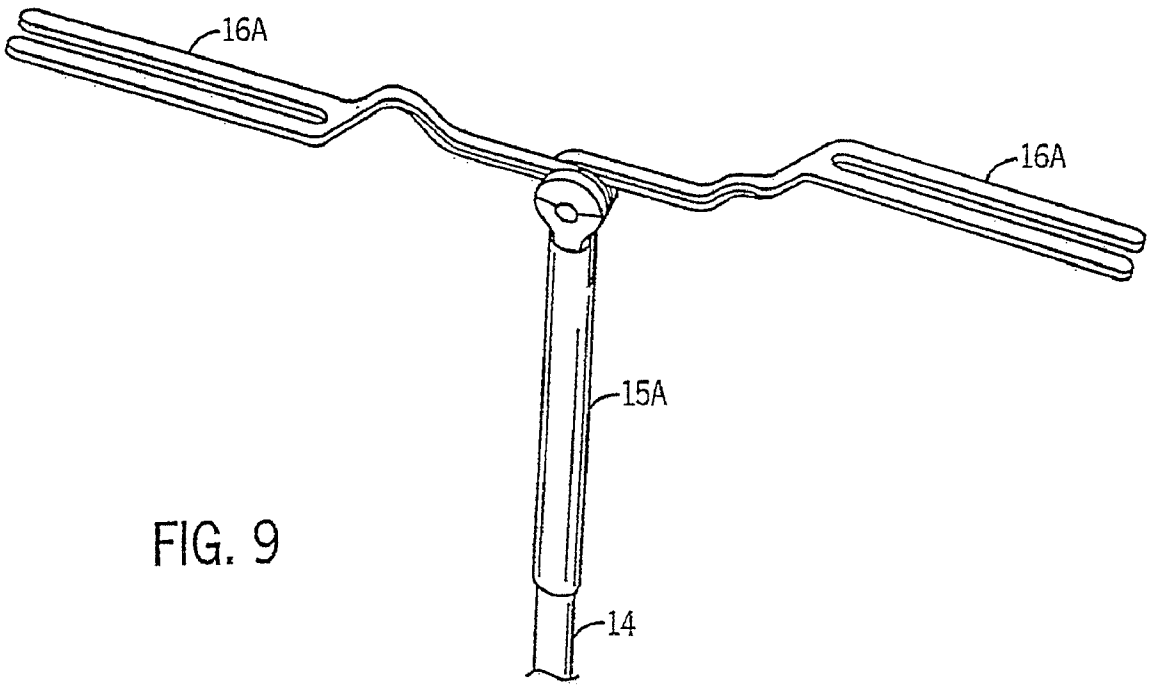
FIG. 9 is an alternative embodiment in which two such support heads are mounted for rotation.

FIG. 9 shows an alternative embodiment in which the telescoping handle parts have a modification to the forward end of the shank 15A as described below, and have two similar support heads 16A with a slightly different axle feature as described below. The support heads 16A do not have integral axles 26. Instead, when their wheels are aligned side to side inside the shunt mount, they each have a through hole where the axle would be.

In this embodiment, the catch 20A (not shown) would have a wide enough projection 31 so that a single projection can interfere with rotation of both support heads 16A. Alternatively, there could be two such catches mounted in the end of the shank 15A. In any event, the resilient catch or catches interfit with the wheels of the support heads 16A to provide similar resistive force permitting dusting without adjustment, yet allowing torque over a certain threshold to permit adjustment.

While a system, e.g., resilient catch, with the recesses on the support head and the catch on the shank are the preferred controlling system, the recesses could instead be positioned on the shank with the catch on the support head. Alternatively, fluidic or other threshold damping systems could be applied to achieve the desired function.

Also, it is not necessary that the support head have a forked end, as distinguished from a single unitary mounting slab. Further, it is not necessary that the catch 20 be a single piece. Various other types of resilient catching means can be provided which drives a blocker into a temporary interference with the pockets 29 (e.g. a spring under a catch member). It is, however, desirable that the force needed to remove the blocking member from the recess be such as to restrict support head rotation during normal dusting, yet permit support head rotation when adjustment is truly intended.

FIGS. 10-31 illustrate a third embodiment of the present invention. The third embodiment provides for a cleaning system 233 that preferably includes a telescoping holder, dusting device or cleaning tool 210 that allows for a large degree of extension (about 1187 mm) for the dusting of ceilings and floors, while at the same time providing for a device that can be easily collapsed to about 390 mm for the dusting of easier to reach surfaces. The dusting device 210 further provides for multiple supports, cleaning support heads, or cleaning pad supports 216, 218 capable of supporting multiple cleaning pads 11, thereby increasing the surface area of the cleaning surface and the ease of cleaning or dusting large surfaces such as floors and ceilings.

Figure 10:
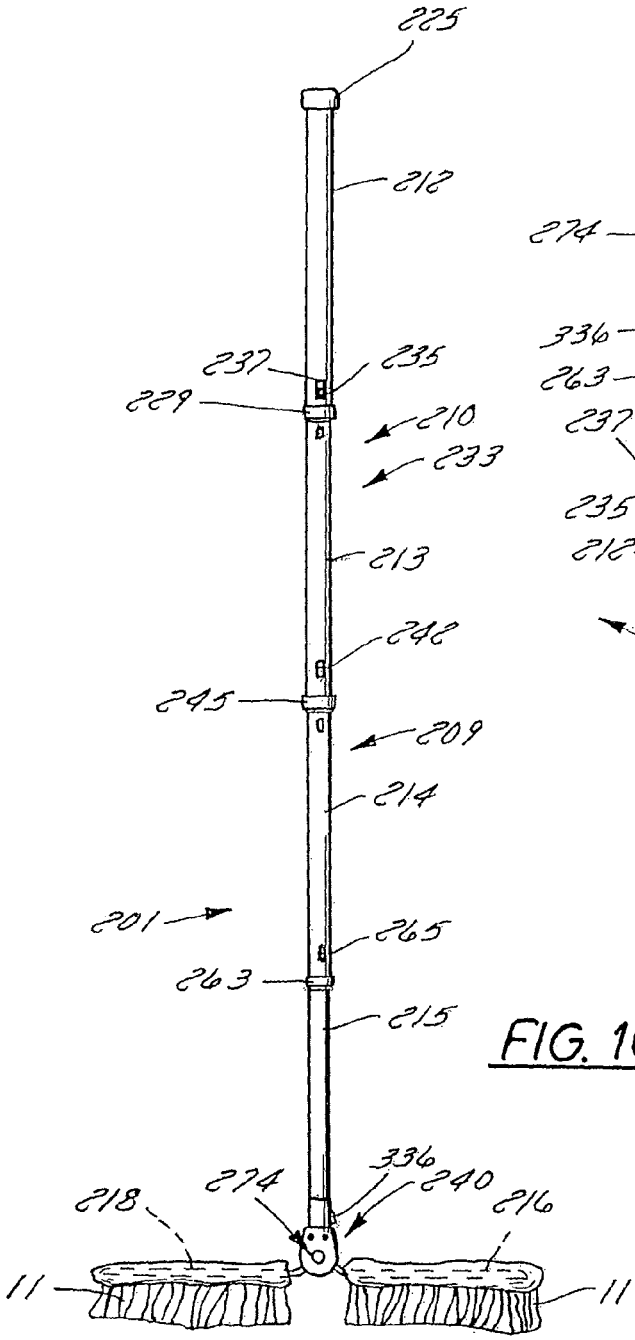
FIG. 10 is a front plan view of a third embodiment of an assembled cleaning implement holder of the present invention, shown in an elongated configuration and illustrating a two support head system with both support heads extended perpendicular to the handle.

As best seen in FIG. 10, the inventive cleaning system 233 includes a holding device, dusting device or cleaning tool 210 designed to be used with a cleaning implement, for example, replaceable dusting sleeve, cleaning mitt, or cleaning pad 11. The cleaning tool 210 includes a telescoping support 209 comprised of a plurality of telescopingly received shafts or sections (212, 213, 214, 215). More specifically, a telescoping grip section 212, first extension piece 213, second extension piece 214, and shank 215 fit over one another respectively and support a pivot support, head or forward mount 240. The shafts 212, 213, 214 and 215 may be freely extended into a locked fully extended position 201 and released via depression of a first engaging projection 239. A primary support, e.g., a primary support head 216 and secondary support, e.g., secondary support head 218 are pivotally mounted to the forward mount 240 on a single gear 274 (See, e.g., FIG. 2*a*) and releasably locked together.

Individual components constituting the holding device or cleaning tool 210 are all made of synthetic resin, such as ABS, vinyl chloride, PE (polyethylene), PP (polypropylene) and PET (polyethylene terephthalate). In an alternative, at least a few of the components may be made of light metal such as aluminum or light alloy such as aluminum alloy.

FIGS. 18-23 illustrate the components of the telescoping support 209. The grip 212 is a hollow cylinder defining a cylindrical inner space 227 axially inside of it. Grip 212 is preferably dimensioned to allow a user to comfortably fit his or her hand around the grip 212 and manipulate the cleaning tool 210. The outer surface of grip may include ergonomically designed features to increase the comfort of the tool 210. Cushions or other grip enhancing features may also be added.

As will be discussed in greater detail below, the hollow cylindrical inner space 227 is dimensioned to slidably fit over the first extension piece 213, second extension piece 214, and shank 215 in a collapsed or retracted position. (See, e.g., FIG. 18). At the distal end of the grip 212 is an end cap 225. End cap 225 may be a separately formed piece or integrally formed with the grip 212. At the proximal end of the grip 212 is a grip collar 229. A slide-retaining member 231 (FIG. 19) extends through the collar 229 and grip 212 into a longitudinal slot 232 of the first extension piece 213 to maintain the grip in alignment with the first extension piece 213 during expansion and retraction. A rectangular spring receiving slot 235 is defined adjacent the collar 229 on the grip and configured for receiving the head 237 of a first retention spring or engaging projection 239 attached to and extending through the distal end of the first extension piece 213.

Figure 21:
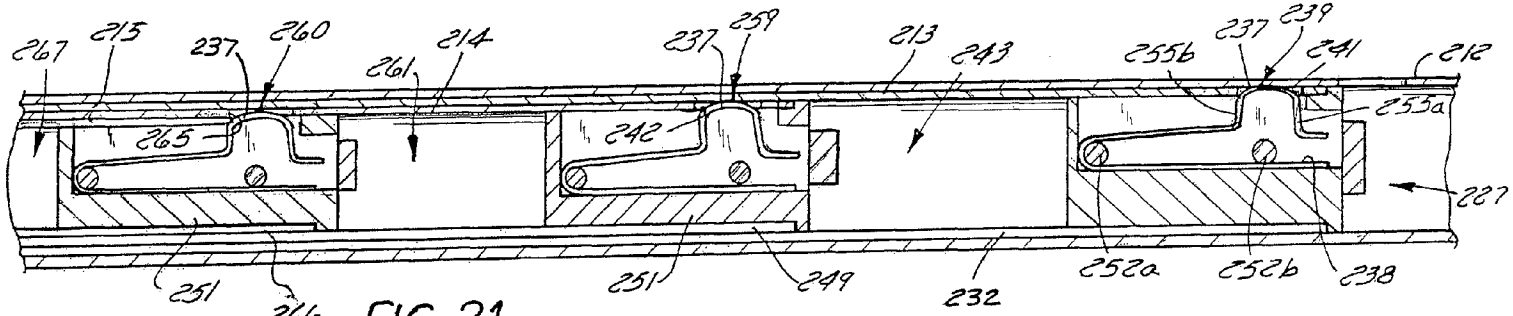
FIG. 21 is a partial cross-sectional view of the telescoping support of the third embodiment in a retracted position showing all of the engaging projections in a semi-collapsed position.
Figure 22:
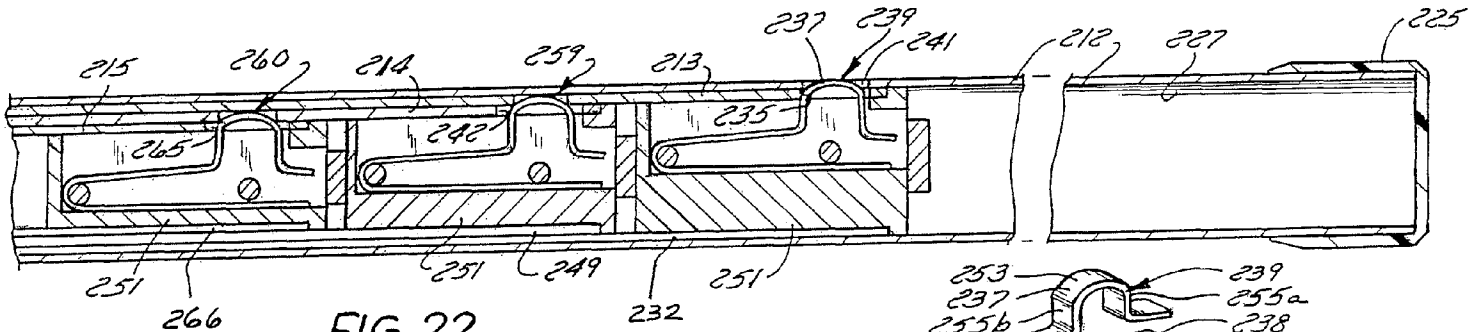
FIG. 22 is a partial cross-sectional view of the telescoping support of the third embodiment of the present invention showing the first engaging projection extending through and a slot in the grip and the two remaining engaging projections in a semi-collapsed position.
Figure 23:
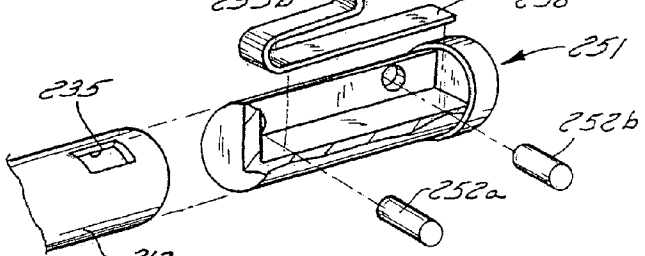
FIG. 23 is an exploded partial cross-sectional view of an engaging projection of the telescoping support and housing of the third embodiment of the present invention.

As illustrated in FIGS. 21-23, first retention spring or engaging projection 239 is retained in an annular housing 251 configured to fit within the distal end of the first extension piece 213. The engaging projection 239 is secured to an inner wall of the housing 251 by a pair of fasteners 252*a*, 252*b*. Engaging projection 239 is preferably a spring biased retaining member comprising a longitudinally extending base 238 and a spring biased head 237. Head 237 includes a rounded or angled upper surface 253 configured to fit within slots 235, 242, 265, FIG. 22. Head side edges 255*a*, 255*b* extend downwardly from the rounded surface 253 and are configured to engage the edges of the slots 235, 242, 265 when extended therethrough in a locking position. (See e.g. 239 in FIG. 22). The rounded or angled head of the engaging projections 239, 259 and 260 allow the engaging projections 259, 260 to be disengaged from the slots 242, 265 by the sliding of the grip 212 and first extension piece 213 respectively over them as will be described in greater detail below.

Slidably received within hollow cylindrical space 227 of the grip 212 is the first extension piece 213. First extension piece 213 is a hollow cylinder defining a cylindrical inner space 243 axially inside of it. The hollow cylindrical inner space 243 is dimensioned to enable the first extension piece 213 to slidably fit over the second extension piece 214, and shank 215. Extending longitudinally along the first extension piece is a slot 232 configured to receive the retaining member 231 of the grip 212 and maintain the grip 212 and first extension piece 213 in their aligned position. At the proximal end of the first extension piece 213 is a collar 245. A retaining member 247 (FIG. 19) extends through the collar 245 and first extension piece 213 into the longitudinal slot 249 of the second extension piece 214 to maintain the first 213 and second 214 extension pieces of the telescoping support 209 in their aligned position. A rectangular slot 242 (FIG. 18) is defined adjacent the collar 245 and configured for receiving the head 237 of a second retention spring or engaging projection 259 attached to and extending through the second extension piece 214. Second engaging projection 259 is identical to the first engaging projection 239 and housing 251 described above.

Slidably received within hollow cylindrical space 243 of the first extension piece 213 is the second extension piece 214. Second extension piece 214 is a hollow cylinder defining a cylindrical inner space 261 axially inside of it. The hollow cylindrical space 261 is dimensioned to slidably fit over the shank 215. Extending longitudinally along the second extension piece 214 is a slot 249 configured to receive the retaining member 247 of the first extension piece 213 and maintain the second extension piece 214 and first extension piece 213 in their aligned position. At the proximal end of the second extension piece 214 is a collar 263. A retaining member 264 (FIG. 19) extends through the collar 263 and second extension piece 214 into a longitudinal slot 266 of the shank 215 to maintain the second 214 extension piece and the shank 215 of the telescoping support 209 in their aligned position. A rectangular slot 265 is defined adjacent the collar 263 and configured for receiving the head 237 of a third retention spring or engaging projection 260 attached to and extending through the shank 215. Third engaging projection 260 is identical to the first 239 and second 259 engaging projections described above.

Slidably received within hollow cylindrical space 261 of the second extension piece 214 is the shank 215. Shank 215 is also a hollow cylinder defining a cylindrical inner space 267 axially inside of it. Extending longitudinally along the shank 215 is slot 266 configured to receive the retaining member 264 of the second extension piece 214 and maintain the shank 215 and second extension piece 214 in their aligned position. Attached to the proximal end of the shaft 215 a pivot support, head, or forward mount 240. A primary support head 216 and secondary support head 218 are pivotally mounted to the forward mount 240 as described below.

As it can be appreciated from the discussion above, the components of the telescoping support 209 allow the cleaning tool 210 to be extended from a maximum length of extension (about 1187 mm) from a fully collapsed orientation of about 390 mm. The telescoping support 209 may be collapsed via the actuation of a single actuator, namely the first retention spring or engaging protection 239. Extension of the telescoping support 209 does not require the actuation of any of the engaging projections as discussed below.

Figures 18, 19, 20:
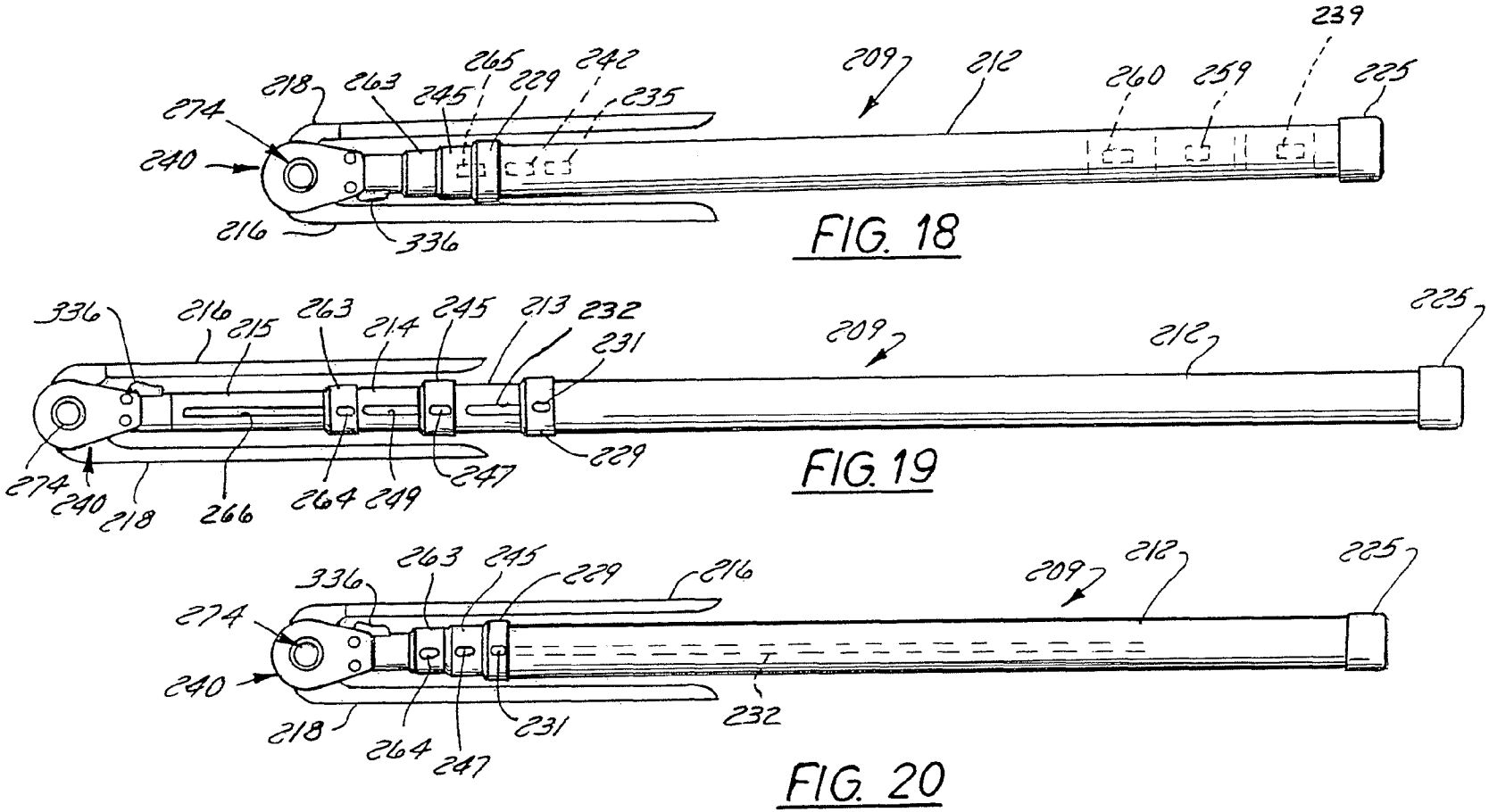
FIGS. 18-20 are alternating plan views of the third embodiment of the present invention.

As illustrated in phantom in FIG. 18 and FIG. 21, in the fully collapsed state, the spring loaded engaging projections 239, 259 and 260 remain collapsed within their relative component parts. The components of the telescoping support 209 are free to slide in the axial direction defined by the respective slots 232, 249, 266. The sliding mechanism is limited rotationally limited by the engagement of the retaining members 231, 247, and 264 in their respective slots 232, 249 and 266.

The sequential extension of the telescoping support 209 from its collapsed position (e.g. FIG. 18) will now be described. As the shank 215 is fully extended or pulled from the second extension piece 214, the third retention spring or engaging projection 260 attached to and extending through the shank 215 slides into the rectangular slot 265 on the second extension piece 214 thereby locking the fully extended shank 215 to the second extension piece 214. As one continues to pull on the shank 215, the attached second extension piece 214 slides through the first extension piece 213 until the second engaging projection 259 slides into the slot 242 on the first extension piece 213 thereby connecting the first extension piece 213 to the fully extended second extension piece 214 and shank 215. In a similar manner, as one continues to pull on the shank 215, the locked second extension piece 214 causes the first extension piece 213 to slide through the grip 212 until the first engaging projection slides into the slot 235 on the grip 212 thereby locking the telescoping support 209 in its fully extended state, illustrated in FIGS. 10, 12, 13 and 15.

It should be apparent from the above disclosure that the telescoping support 209 could be extended in an alternative manner, namely by extending the first extension 213 and slidably stored second extension piece 214 and shank 215 from the grip and then extending the second extension piece 214 and slidably stored shank 215 from the first extension piece. Finally one could extend the shank 215 from the second extension piece 214 with the same results as described above. Each of the engaging projections 239, 259 and 260 will slide within the piece around it until it reaches and locks into its respective slot 265, 242, 235.

Due to the unique configuration of the telescoping support 209, the telescoping support 209 can be collapsed from its fully extended position illustrated in FIG. 10 by actuation or depression of a single engaging projection, namely first engaging projection 239 extending through slot 235 in grip 212. Actuation of engaging projection 239 allows grip 212 to be released and moved forwardly towards the forward mount 240. As the grip 212 moves forward, the collar 229 engages the second engaging projection 259 extending through the slot 242 on the first extension piece 213. Due to the rounded or angled head 237 of the of the second engaging projection 259 the forward movement of collar 229 forces the second engaging projection 259 downward from the slot 242 thereby releasing the first extension piece 213. As the first extension piece 213 is moved forward, the collar 245 engages the third engaging projection 260 extending through slot 265 on second extension piece 214. Similarly, the rounded head 237 of the third engaging projection allows the forward movement of the collar 245 to force the third engaging projection 260 downward from the slot 265 thereby releasing the second extension piece 214. Second extension piece may then slide forward over the shank 215 to fully collapse the telescoping support 209.

FIGS. 24-31 illustrate the components of the forward mount 240. Forward mount 240 includes a two-piece housing 271 comprised of mating first 272*a* and second 272*b* halves. Housing 271 defines an engagement stub 273 configured to be press fitted or glued into the cylindrical inner space 267 of shank 215. Pivotably received within housing are the primary support head 216 and secondary support head 218.

Primary support head 216 and secondary support head 218 each include a support head 300 supported by a linking section 224 which connects to a hub 301*a*, 301*b*, including circular gear receiving recess 275*a*, 275*b*. In the preferred embodiment, support head 300 of cleaning pad includes a pair of parallel attachment members, tines or attachment prongs 302*a*, 302*b* configured to engage the pockets or sleeves 304*a*, 304*b* of a cleaning pad 11 as is generally known in the art. Attachment members 302*a*, 302*b* may be spaced apart in a variety of configurations. Attachment members 302*a*, 302*b* define a rounded leading edge 306 configured for ease of insertion into the sleeves 304*a*, 304*b* of cleaning pad 11. It is recognized that although the preferred embodiment illustrates a pair of attachment members 302*a*, 302*b* multiple configurations may be utilized. For example, a single, wider attachment member could be utilized. Alternatively, three or more attachment members could be utilized.

Attachment members 302*a*, 302*b* include a plurality of spaced cleaning pad retaining tabs, barbs or projections 308 projecting from a first surface 310. In the illustrated embodiment, retaining tabs 308 are triangular-shaped. The unique triangular configuration of the retaining tabs 308 serves a dual function allows for ease of placement of the cleaning pad 11 on the attachment members 302*a*, 302*b* during assembly, while also retaining the cleaning pad 11 on the attachment members 302*a*, 302*b* during the cleaning motion.

In one embodiment, the attachment members 302*a*, 302*b* may be expandable, inflatable, partially inflatable, or include an inflatable portion. The inflatability provides for an improved fit of the cleaning pad 11 on the attachment members 302*a*, 302*b* as well as facilitating hands free removal of the cleaning pad 11 from the attachment members 302*a*, 302*b*.

Figure 24:
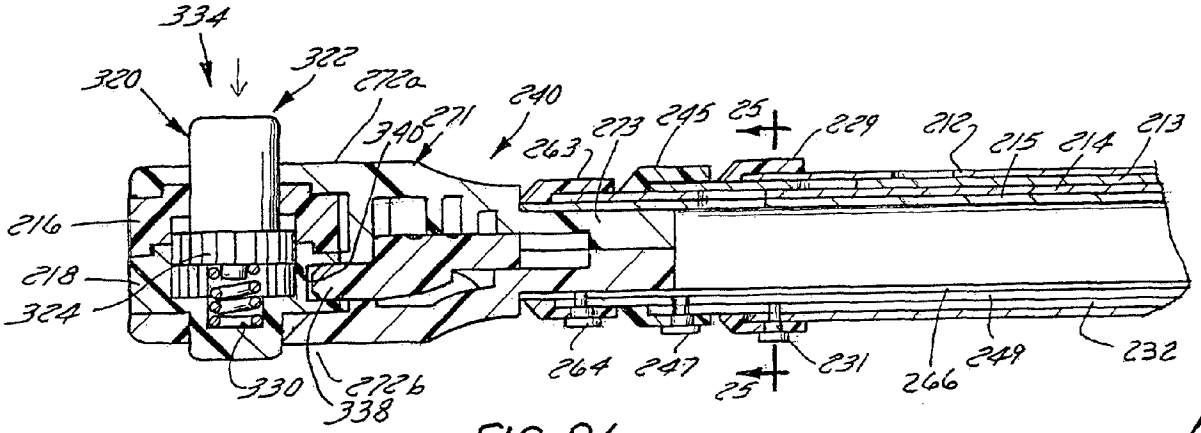
FIG. 24 is a partial cross-sectional view of the forward mount of the third embodiment of the present invention.
Figure 25:
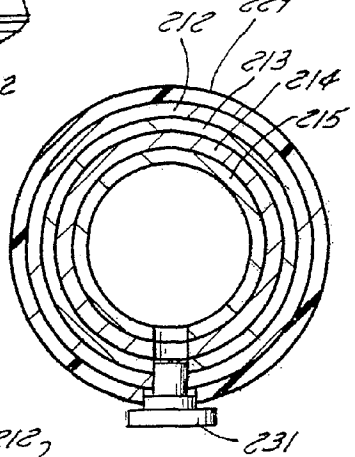
FIG. 25 is a sectional view taken along line 25-25 of FIG. 24.
Figure 26:
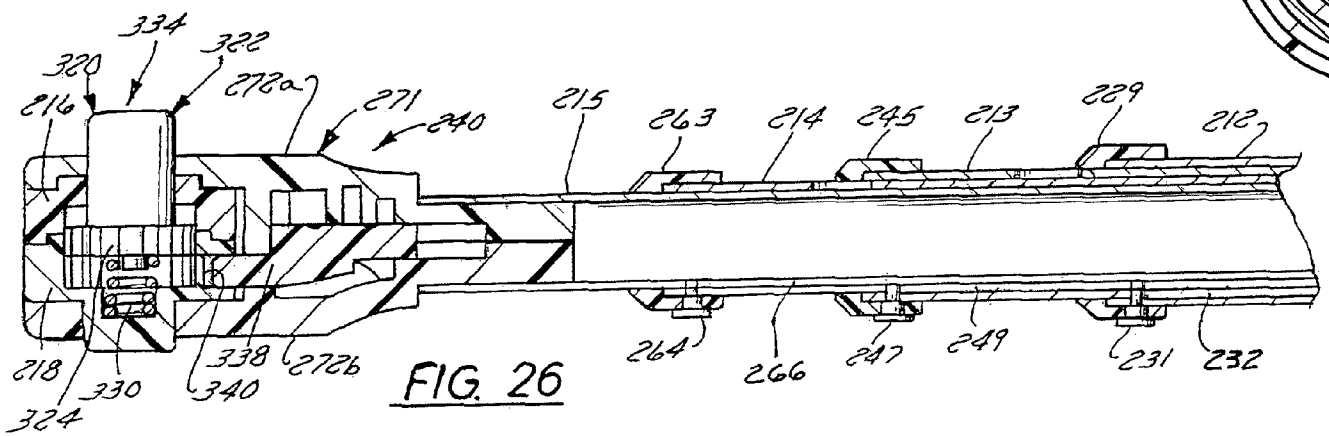
FIG. 26 is a partial cross-sectional view of the forward mount of the third embodiment of the present invention.
Figure 30:
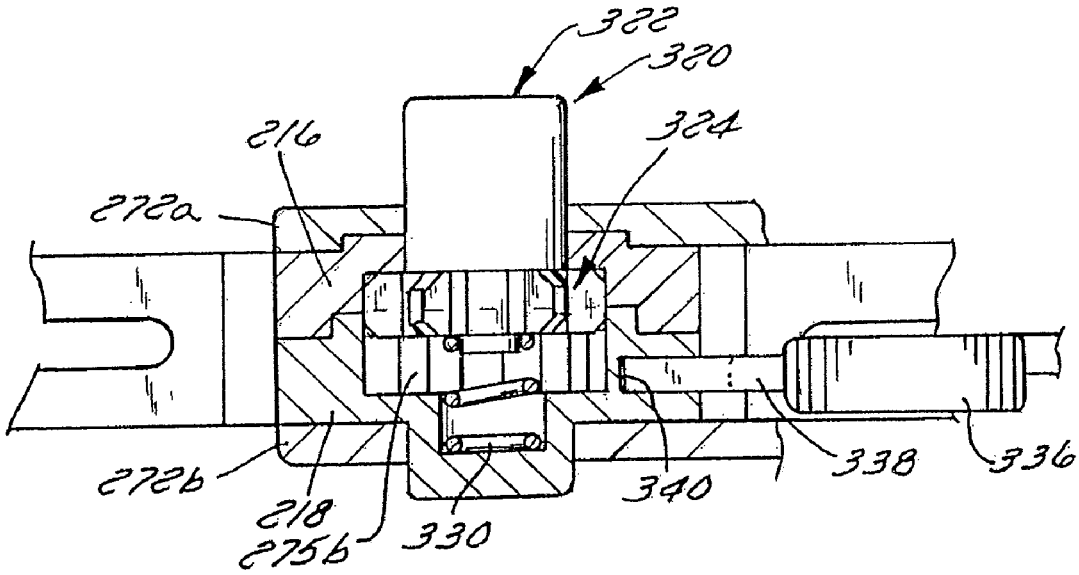
FIG. 30 is a partial cross-sectional view of the forward mount of the third embodiment of the present invention illustrating the gear in a locked position.
Figure 36:
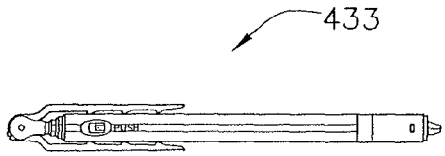
FIG. 36 is a front plan view of the fourth embodiment of the present invention illustrating the support heads in a fourth or storage configuration.
Figure 35:
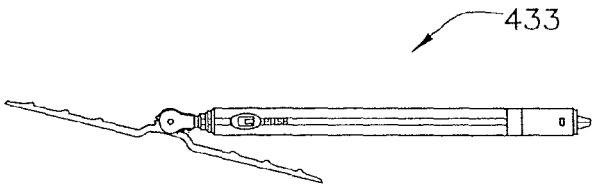
FIG. 35 is a front plan view of the fourth embodiment of the present invention illustrating the support heads in a third configuration.
Figure 34:
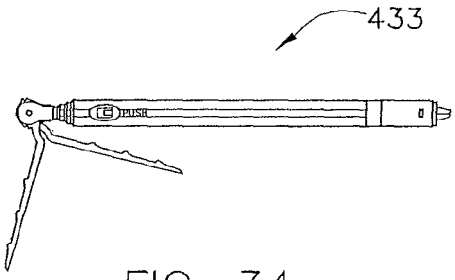
FIG. 34 is a front plan view of the fourth embodiment of the present invention, illustrating the support heads in a second configuration.
Figure 33:
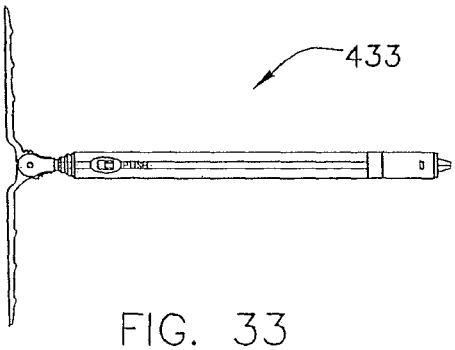
FIG. 33 is a front plan view of the fourth embodiment of the present invention, illustrating the support heads perpendicular to the handle.

Primary support head 216 and secondary support head 218 are selectively pivotably mounted on a single pivot 320, namely a spring biased gear 274. Gear 274 is a rod like member having a button 322 on one side configured to extend through the hub 301*a* of the primary support and the housing 271 such that it can be depressed by a user to allow for movement of the primary support head 216. Opposite the button 322 on the gear 274 is a cog 324. Cog 324 includes a plurality of teeth 326 configured to engage mating slots 328 in the gear receiving recesses 275*a*, 275*b* in the primary 216 and secondary 218 support heads. As illustrated in FIGS. 24, 26 and 30, gear 274 is biased by spring 330 into a locked position 331 such that the cog 324 is midway between the primary 216 and secondary 218 support heads such that it engages the slots 328 in both the gear receiving recesses 275*a*, 275*b*. In the locked position 331, the teeth 326 of cog 324 mate with slots 328 within the gear receiving recesses 275*a*, 275*b* of the primary 216 and secondary 218 support heads.

Figures 12, 13:
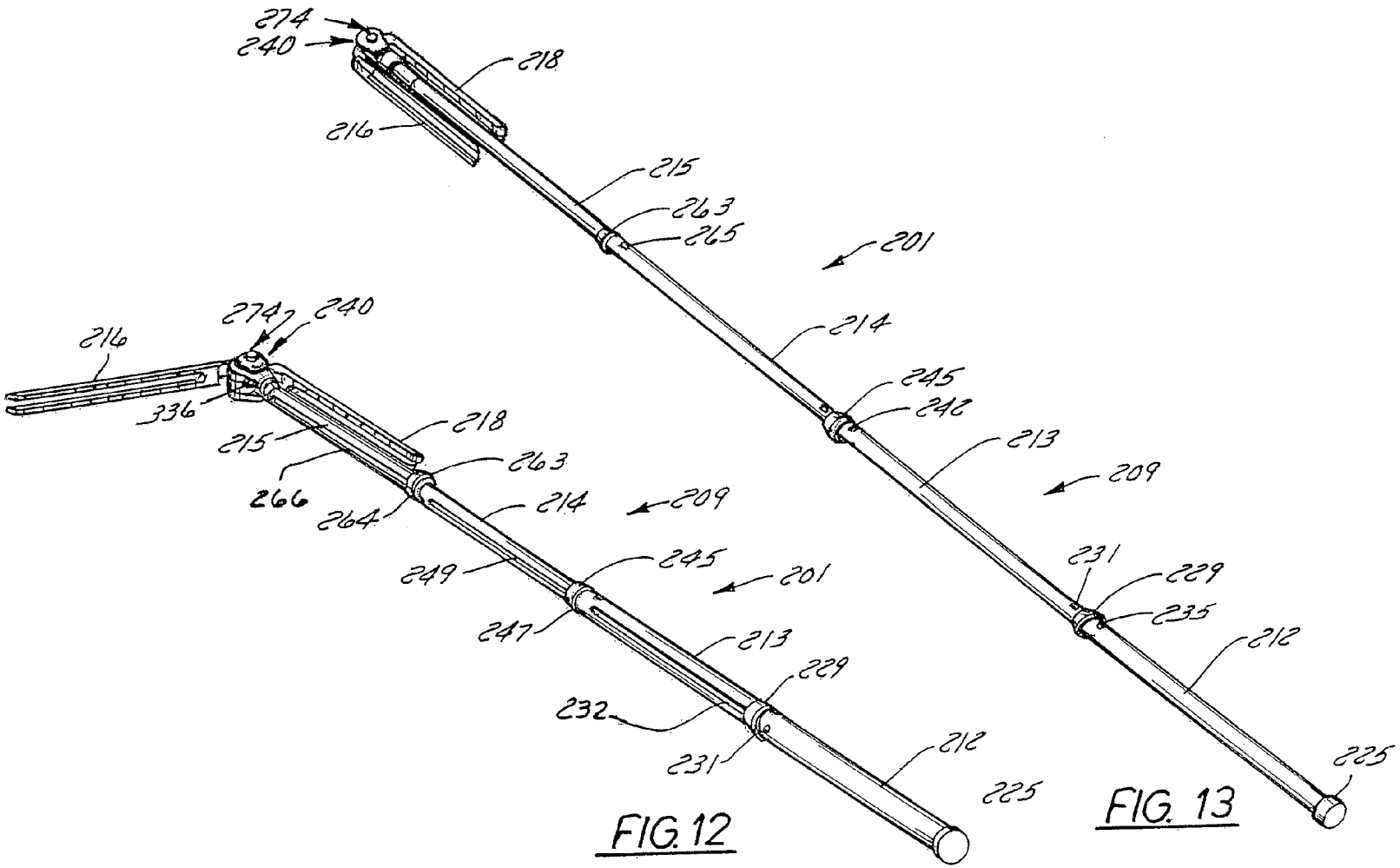
FIG. 12 is a side perspective view of the third embodiment of the present invention, shown in an elongated configuration and illustrating a secondary support head in a storage position and a primary support head extended perpendicular to the handle.
FIG. 13 is a side perspective view of the third embodiment of the present invention, shown in an elongated configuration and illustrating both support heads in a storage position.

In addition to the gear 274, secondary support head 218 is also releasably engaged by a slider 336 slidably mounted to the exterior of the housing 271. Slider 336 includes an engagement tab 338 configured to engage a recess 340 in the hub 301*b* of secondary support head 218 thereby locking secondary support head 218 in a fixed storage position. In the illustrated embodiment, the slider 336 locks the secondary support head 218 in a folded storage position parallel to the telescoping support 209 as illustrated in FIG. 12.

Figure 17:
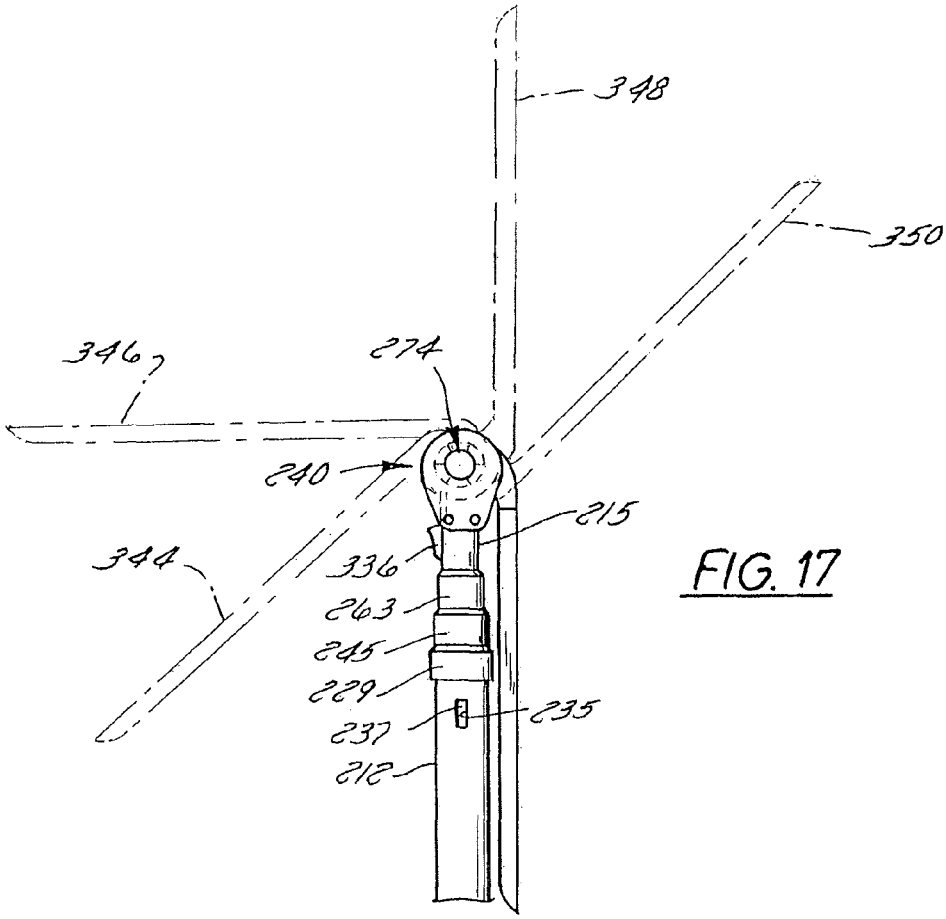
FIG. 17 is a view of the third embodiment of the present invention, illustrating a secondary support head in a storage position and a primary support head in phantom illustrating several cleaning positions.
Figure 16:
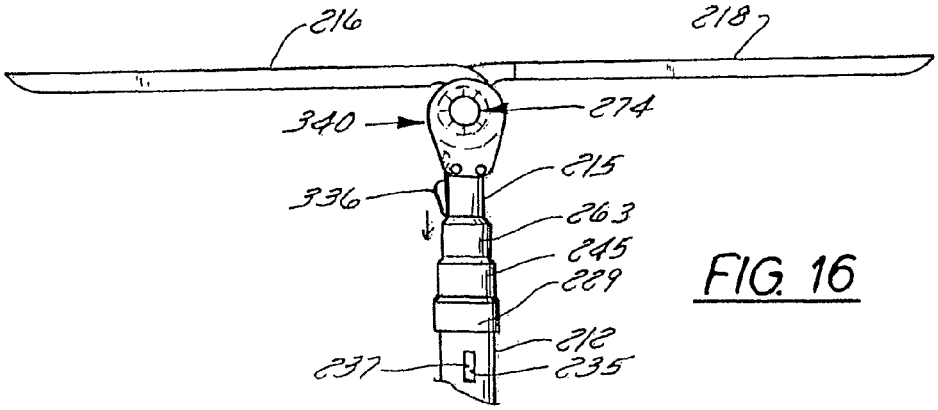
FIG. 16 is a partial front plan view of the third embodiment of the present invention, illustrating both support heads extended perpendicular to the handle.
Figure 31:
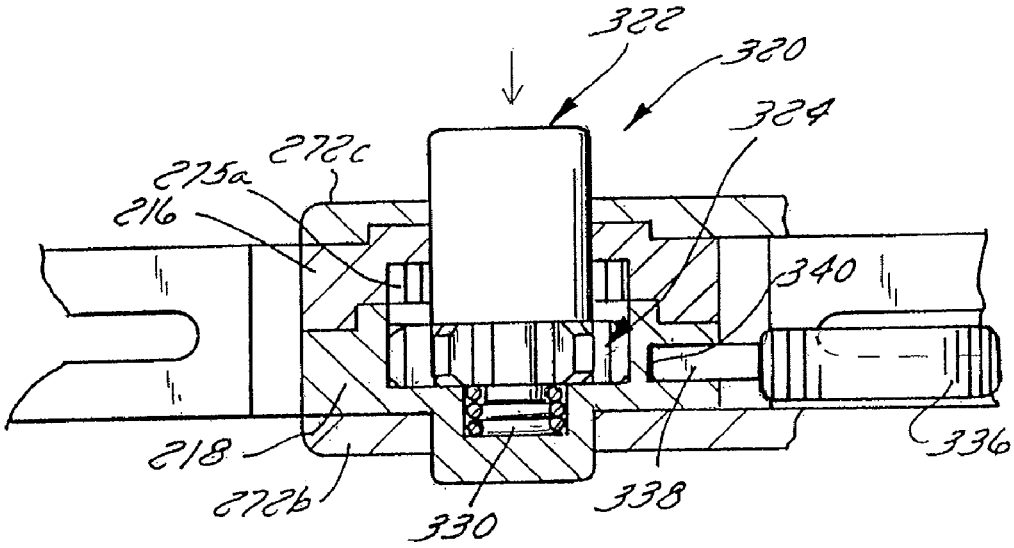
FIG. 31 is a partial cross-sectional view of the forward mount of the third embodiment of the present invention illustrating the gear in an unlocked position.

Depression of the button 322 in the direction indicated by arrow 334 releases the primary support head 216 and allows it to pivot 225 degrees in relation to the telescoping support 209. As illustrated by FIG. 31, as the button 322 is depressed, the cog 324 is moved completely into the gear receiving recess 275*b* of the secondary support head 218 thereby allowing the primary support head 216 to pivot freely until the button 322 is released. Once the button 322 is released, the spring 330 will bias the cog 324 back into a locking position in the gear receiving recess 275*a* of the primary support head 216. FIG. 17 illustrates the alternative locked positions of the primary support head.

Figure 14:
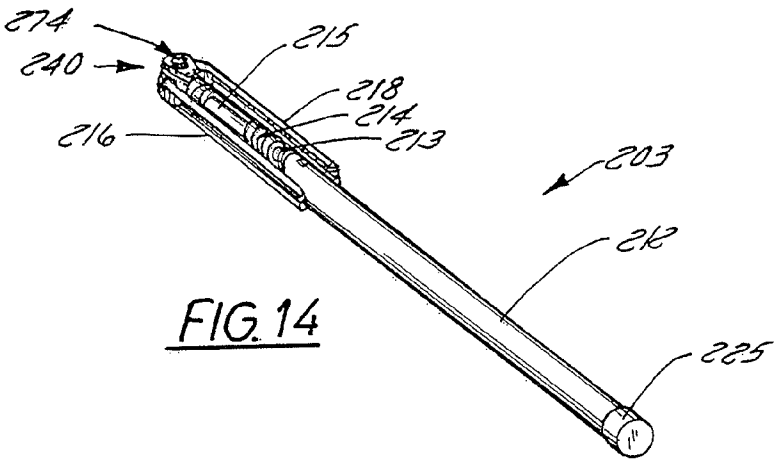
FIG. 14 is a side perspective view of the third embodiment of the present invention, shown in a retracted configuration and illustrating both support heads in a storage position.
Figure 15:
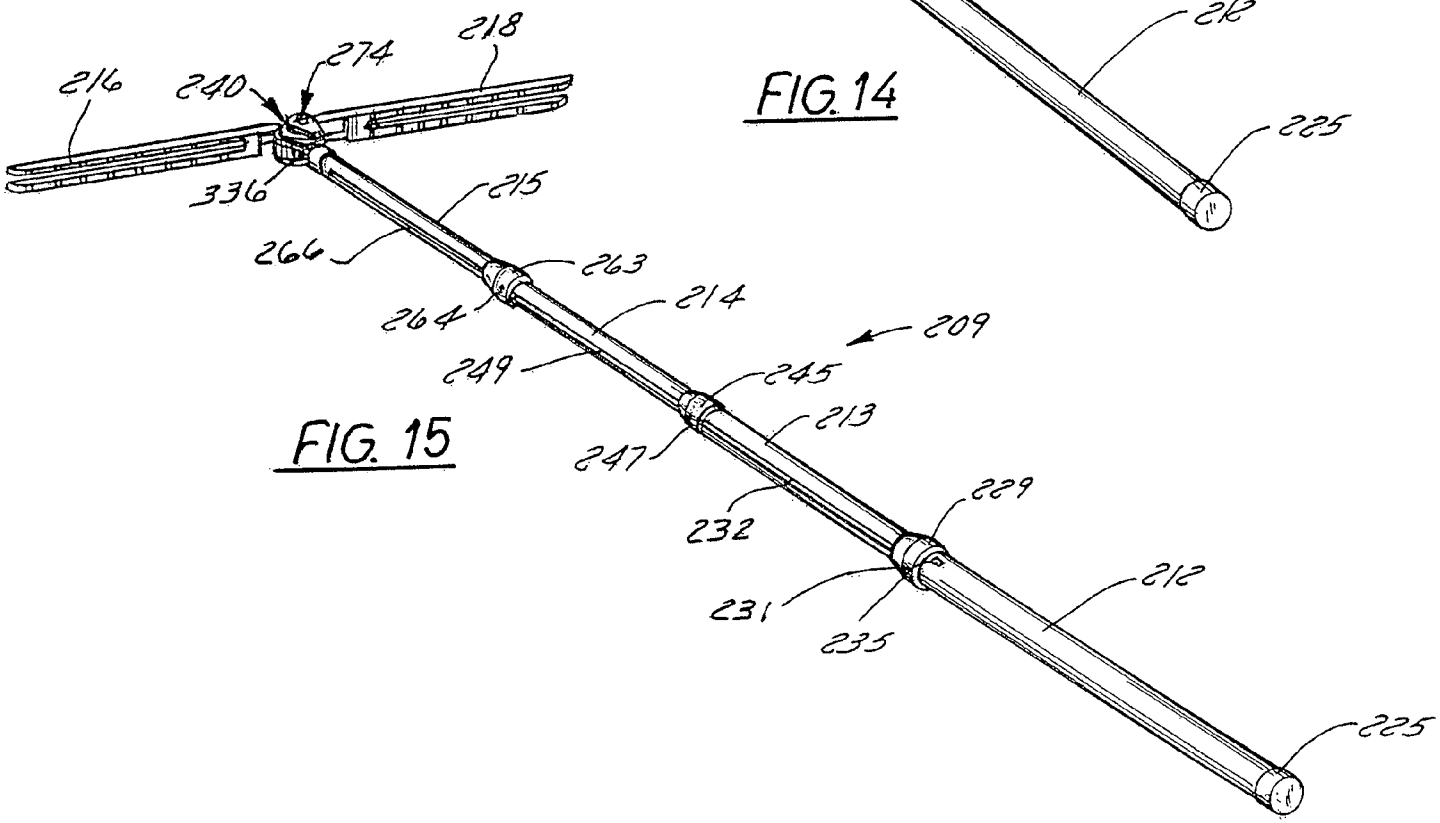
FIG. 15 is a side perspective view of the third embodiment of the present invention, shown in an elongated configuration and illustrating both support heads extended perpendicular to the handle.

In the preferred embodiment, cog 324 has enough teeth 326 and gear receiving recess 275*a* of the primary support head 216 has enough slots to allow primary support head 216 to be locked into five alternative angular positions. A primary support head 216 storage position 342 is illustrated in FIG. 14. As illustrated in phantom in FIG. 17, primary support head 216 may also be selectively locked into a 45 degree position 344, a 90 degree position 346, a 135 degree position (not shown), a 180 degree position 348 and a 225 degree position 350. The varying positions allow the cleaning tool 210 to be used for a variety of cleaning tasks.

Figure 11:
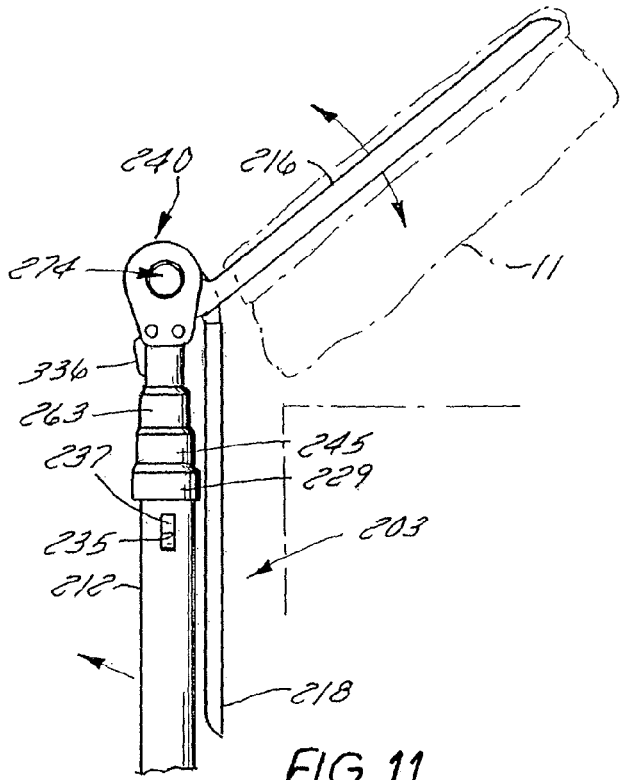
FIG. 11 is a partial front plan view of the cleaning implement holder illustrated in FIG. 10 illustrating the forward mount with the two support heads attached.

As apparent from the description and figures, the cleaning tool 210 may be used in both a short or collapsed configuration 203 illustrated in, e.g., FIG. 11 and a locked fully extended position 201. Use of the cleaning tool 210 in the short configuration 203 is ideal for cleaning smaller areas such as shelves or small appliances with a single cleaning pad 11. Initiating with both the primary 216 and secondary 218 support heads in the folded storage position illustrated in FIG. 11, the button 322 may be pressed allowing the primary support head 216 to be moved into one of the five cleaning positions. The button is then released, thereby locking the primary support head 216 into its desired cleaning position. A cleaning pad 11 can then be placed onto primary support 216 and moved across a surface to be cleaned.

Use of the cleaning tool 210 in the locked fully extended position 201 is ideally suited for cleaning larger surfaces such as floors and ceilings. In order to use the cleaning tool in the fully extended position 201, the telescopic support 209 is extended as previously described. The button 322 is then depressed allowing a user to set the primary support head 216. Preferably primary support head is set at a 180 degree position 348 in relation to the handle to allow the heads to be in the same plane. Next, a user moves the slider 336 back to release the engagement tab 338 from the recess 340 in the hub 301*b* of secondary support head 218 thereby releasing secondary support head 218 from a fixed storage position. A cleaning pad 11 can then be placed onto primary support head 216 and secondary support head. Once released from the slider 336, the angle between the primary support head 216 and secondary support head 218 is maintained, while the interlocked primary 216 and secondary 218 support head freely pivot on the gear 274. This freedom of motion is advantageous by allowing a user to freely slide the primary 216 and secondary 218 support heads across a surface to be cleaned from a variety of angles. Once the cleaning task is finished, the telescopic support 209 can be collapsed as previously described and the primary 216 and secondary 218 support heads can be returned to their storage position illustrated in FIG. 14.

FIGS. 32-49A illustrate a fourth embodiment of the present invention. The fourth embodiment also provides for a cleaning system 433 that preferably includes a telescoping holder, dusting device or cleaning tool 410 that allows for a large degree of extension for the dusting of ceilings and floors, while at the same time providing for a device that can be easily collapsed for the dusting of easier to reach surfaces. The dusting device 410 further provides for multiple supports, cleaning support heads, or cleaning pad supports 416, 418 capable of supporting multiple cleaning pads 11, thereby increasing the surface area of the cleaning surface and the ease of cleaning or dusting large surfaces such as floors and ceilings. The fourth embodiment further provides an alternative locking mechanism for the support heads 416, 418, namely a ratcheting type mechanism that retains the head in a desired position during normal dusting routines and as well as an alternative double I-beam or I-beam shaped shank 415.

As illustrated in FIGS. 32-36, the inventive cleaning system 433 includes a holding device, dusting device or cleaning tool 410 designed to be used with a cleaning implement, for example, replaceable dusting sleeve, cleaning mitt, or cleaning pad 11. The cleaning tool 410 includes an extendable or telescoping support 409 comprised of a plurality of telescopingly received shafts or sections (412, 413, 414, 415). More specifically, a telescoping grip section or grip 412, first extension piece 413, second extension piece 414, and double I-beam or shank 415 fit over one another respectively. A pivot support, head, cradle or forward mount 440 is located at the forward end of shank 415. The shafts 412, 413, 414 and 415 may be freely extended into a locked fully extended position 401 and released via depression of a first engaging projection 439 extending through the grip section 412. A primary support, e.g., a primary support head 416 and secondary support, e.g., secondary support head 418 are pivotally mounted to the forward mount 440 and releasably locked together.

Individual components constituting the holding device or cleaning tool 410 are all made of synthetic resin, such as ABS, vinyl chloride, PE (polyethylene), PP (polypropylene) and PET (polyethylene terephthalate). In an alternative, at least a few of the components may be made of light metal such as aluminum or light alloy such as aluminum alloy.

Figure 39:
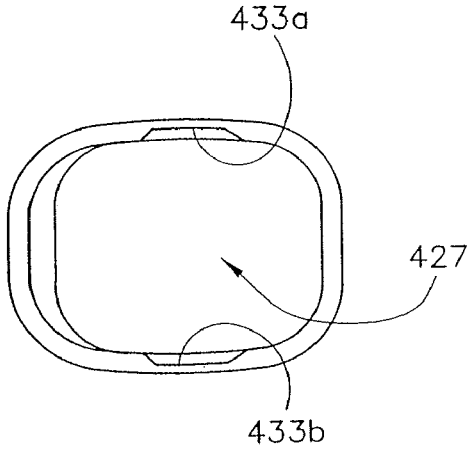
FIG. 39 is a plan view into the inner space of the grip of the fourth embodiment of the present invention.
Figure 38:
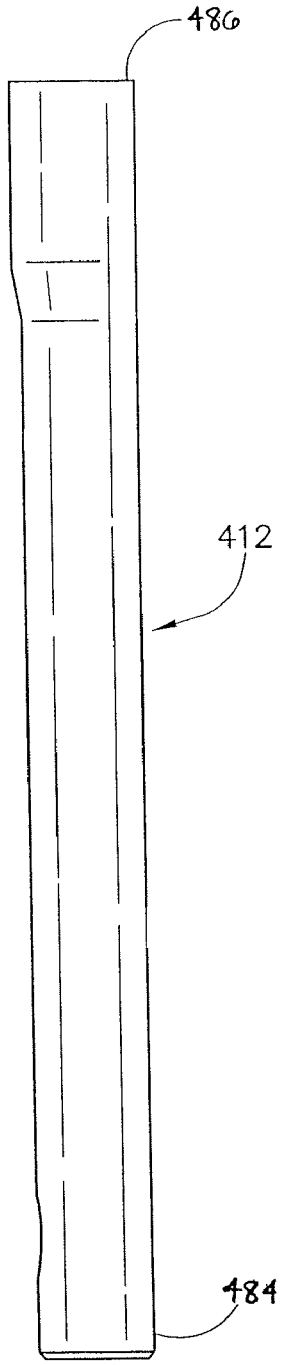
FIG. 38 is a side plan view of the grip of the fourth embodiment of the present invention.

FIGS. 38-46A illustrate the components of the telescoping support 409. Turning initially to FIGS. 38-39, grip 412 is a hollow member defining a generally trapezoidal hollow inner space 427 axially inside of it. The trapezoidal shape is advantageous in that it prevents rotation of the subsequent sections received within grip 412. Grip 412 is preferably dimensioned to allow a user to comfortably fit his or her hand around the grip 412 and manipulate the cleaning tool 410. The outer surface of grip may include ergonomically designed features to increase the comfort of the tool 410. Cushions or other grip enhancing features may also be added.

Figure 40:
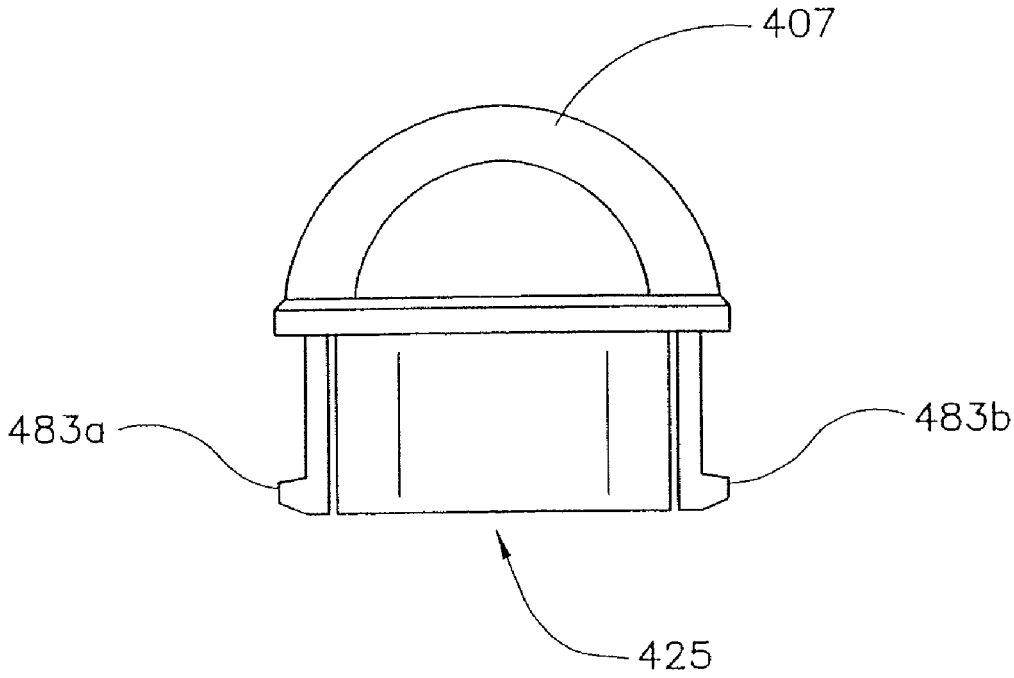
FIG. 40 is a side plan view of an end cap of the fourth embodiment of the present invention.
Figure 41:
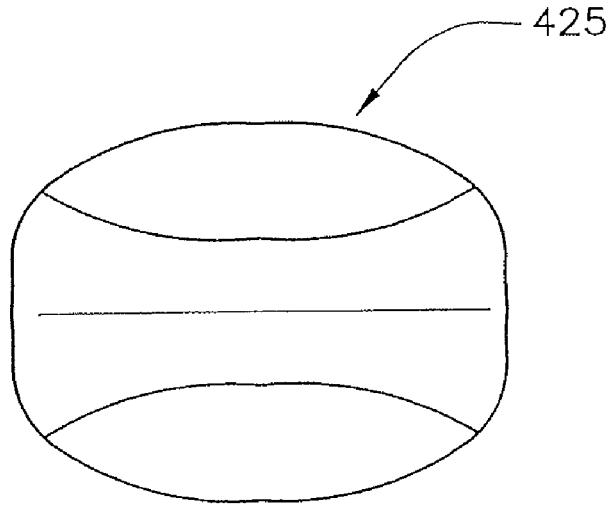
FIG. 41 is a top plan view of the end cap of the fourth embodiment of the present invention.

As will be discussed in greater detail below, the hollow inner space 427 is dimensioned to slidably fit over the first extension piece 413, second extension piece 414, and shank 415 in a collapsed or retracted position. (See e.g. FIGS. 32-36). As illustrated in FIGS. 40 and 41, an end cap 425 is located at the distal end of the grip 412. End cap 425 may be a separately formed piece or integrally formed with the grip 412. End cap 425 preferably includes an arched retaining member 407 for hanging the cleaning tool 410 on a hook, nail or other retaining device for ease of storage. In the illustrated embodiment end cap 425 includes a pair of engaging tabs 483*a*, 483*b* configured to be received in slots 485*a*, 485*b* to secure the end cap 425 to the grip 412.

Figure 38A:
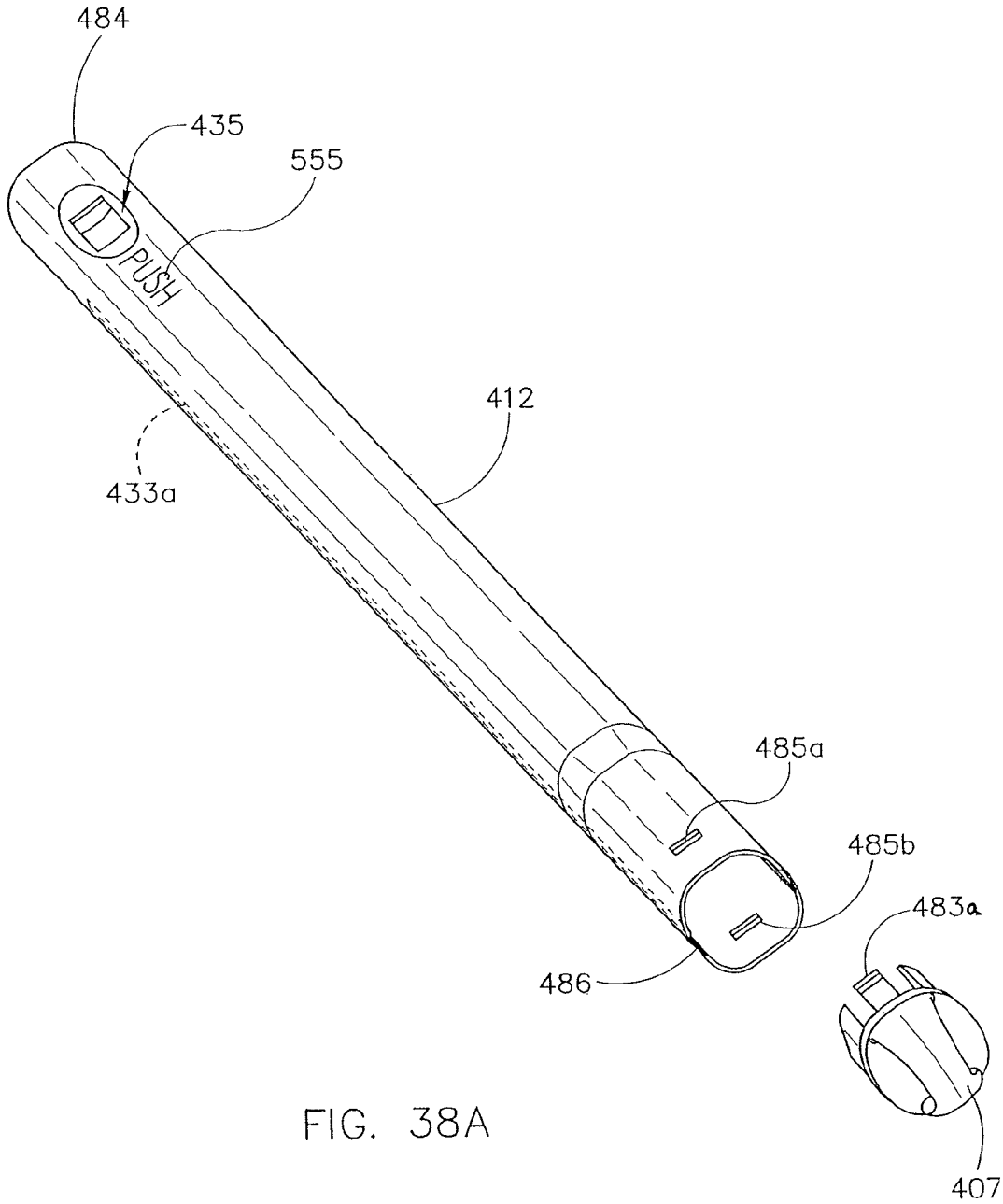
FIG. 38A is a perspective view of the grip of the fourth embodiment of the present invention.

As best illustrated in FIGS. 38A and 39, a pair of rectangular longitudinal slots 433*a*, 433*b* extend along opposed sides of the inner space 427 of grip 412. Longitudinal slots 433*a*, 433*b* extend from the rearward end 486 of grip 412, to about one to two inches from forward end 484 of grip. Longitudinal slots 433*a*, 433*b* are configured to slidably receive alignment tabs 431*a*, 431*b* located on the outside surface of first extension piece 413. Slots 433*a*, 433*b* and tabs 431*a*, 431*b* help maintain the grip in alignment with the first extension piece 413 during expansion and retraction. The preferred length of slots 433*a*, 433*b*, stopping about one to two inches from the forward end 484 of grip, acts as a stop preventing first extension piece 413 from being removed from grip 412. A rectangular spring receiving slot 435 is defined adjacent the forward end 484 of grip 412 for receiving the head 437 of a first retention leaf spring or engaging projection 439 integrally attached to the rearward or distal end of the first extension piece 413. Indicia 555 may be included adjacent slot 435 to instruct a user how to collapse or expand the telescopic or telescoping support 409.

Figure 43:
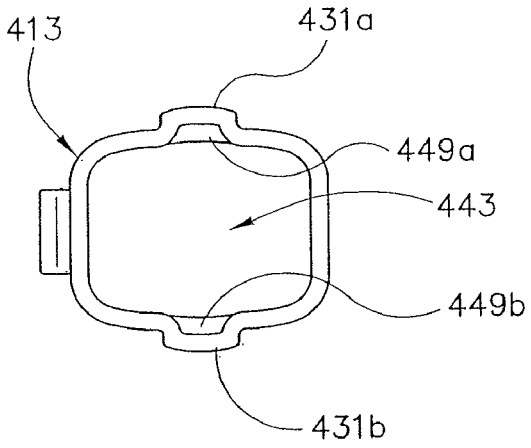
FIG. 43 is a plan view into the inner space of the first extension piece of the fourth embodiment of the present invention.
Figure 42:
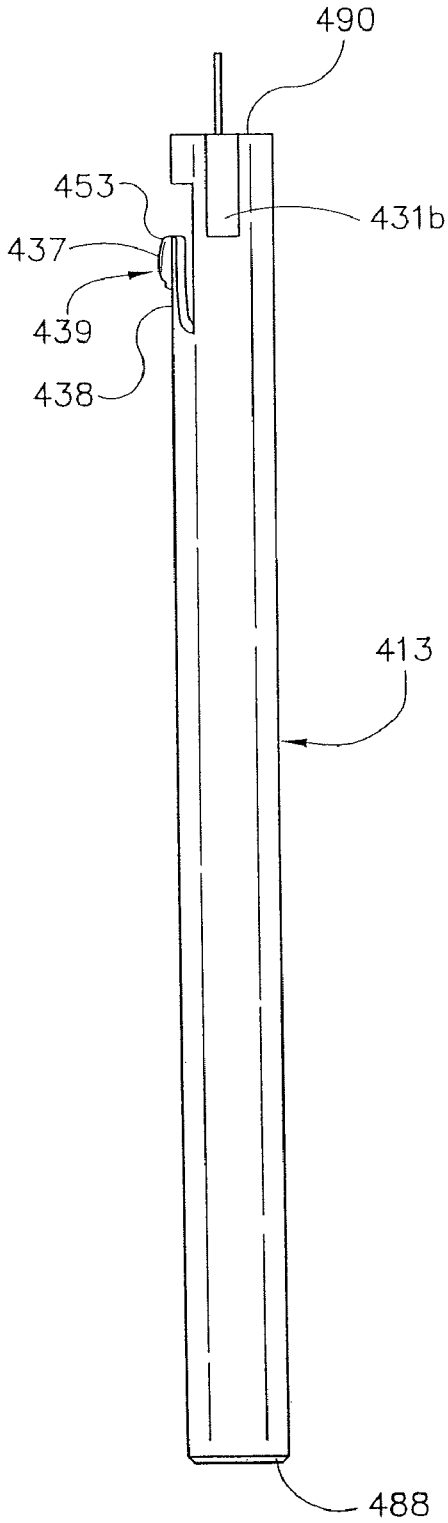
FIG. 42 is a side plan view of the first extension piece of the fourth embodiment of the present invention.

Slidably received within hollow space 427 of the grip 412 is the first extension piece 413. As illustrated in FIGS. 42-43, first extension piece 413 is a hollow member defining a generally trapezoidal inner space 443 axially inside of it. The hollow inner space 443 is dimensioned to enable the first extension piece to slidably fit over the second extension piece 414, and shank 415. A pair of alignment tabs 431*a*, 431*b* located on the outside surface of first extension piece 413 are configured to slidably fit within longitudinal slots 433*a*, 433*b* of grip 412. Similarly, a pair of rectangular longitudinal slots 449*a*, 449*b* extends along opposed sides of the inner space 443 of first extension piece 413. Longitudinal slots 449*a*, 449*b* extend from a rearward end 490 of first extension piece 413, to about one to two inches from forward end 488. Longitudinal slots 449*a*, 449*b* are configured to slidably receive alignment tabs 451*a*, 451*b* located on the outside surface of second extension piece 414. Slots 449*a*, 449*b* and tabs 451*a*, 451*b* help maintain the first extension piece 413 in alignment with the second extension piece 414 during expansion and retraction. The preferred length of slots 449*a*, 449*b*, stopping about one to two inches from the forward end 488 of first extension piece 413, prevents second extension piece 414 from being removed from first extension piece 413. A rectangular spring receiving slot 491 is defined adjacent the forward end 488 of first extension piece 413 for receiving the head of a second retention leaf spring or engaging projection 459 integrally attached to the rearward or distal end of the second extension piece 414.

Figure 42A:
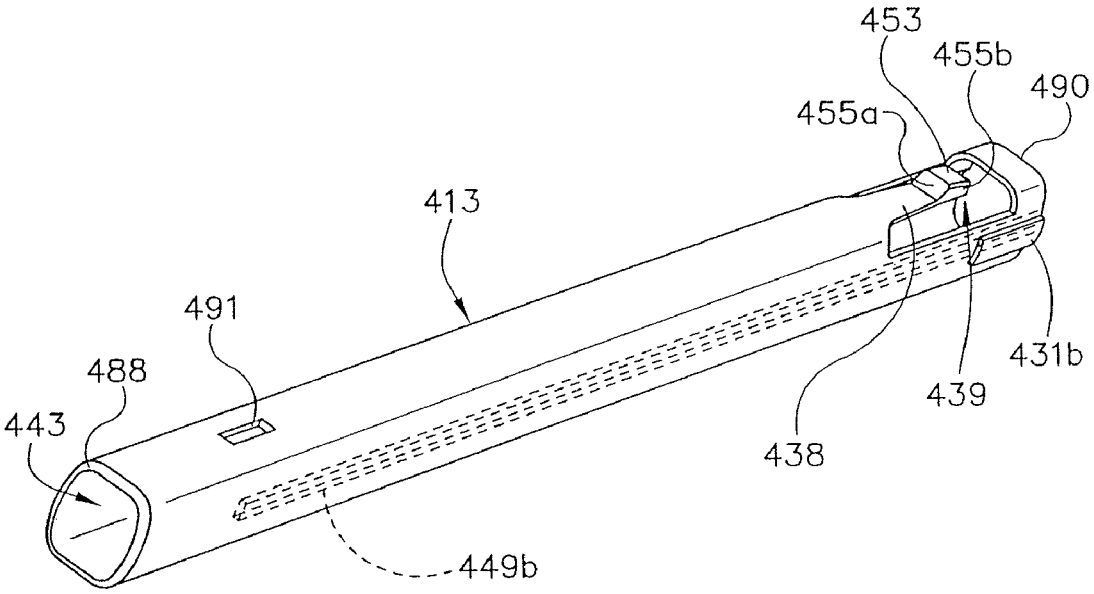
FIG. 42A is a perspective view of the first extension piece of the fourth embodiment of the present invention.

As illustrated in FIGS. 42 and 42A, a first retention spring or engaging projection 439 is integrally formed near the rearward end 490 of first extension piece 413. Engaging projection 439 is a cantilevered spring biased retaining member comprising a longitudinally extending base 438 and a spring biased head 437. Head 437 includes a rounded or angled upper surface 453 configured to fit within slot 435 of grip 412. Head side edges 455*a*, 455*b* extend downwardly from the rounded or slanted head 453 and are configured to engage the edges of the slot 435 when extended therethrough in a locking position. The rounded or angled head 437 of the engaging projection 439 allows the engaging projection 439 to be disengaged from the slot 436 by the sliding of the grip 412 forward as will be described in greater detail below.

Figure 44:
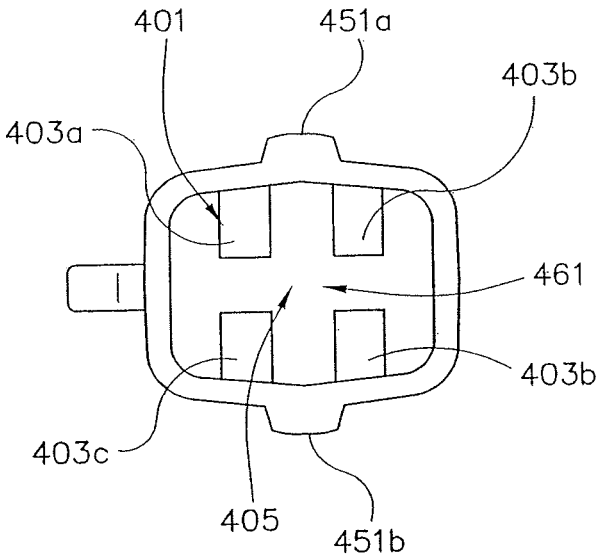
FIG. 44 is a plan view into the inner space of the second extension piece of the fourth embodiment of the present invention.
Figure 45:
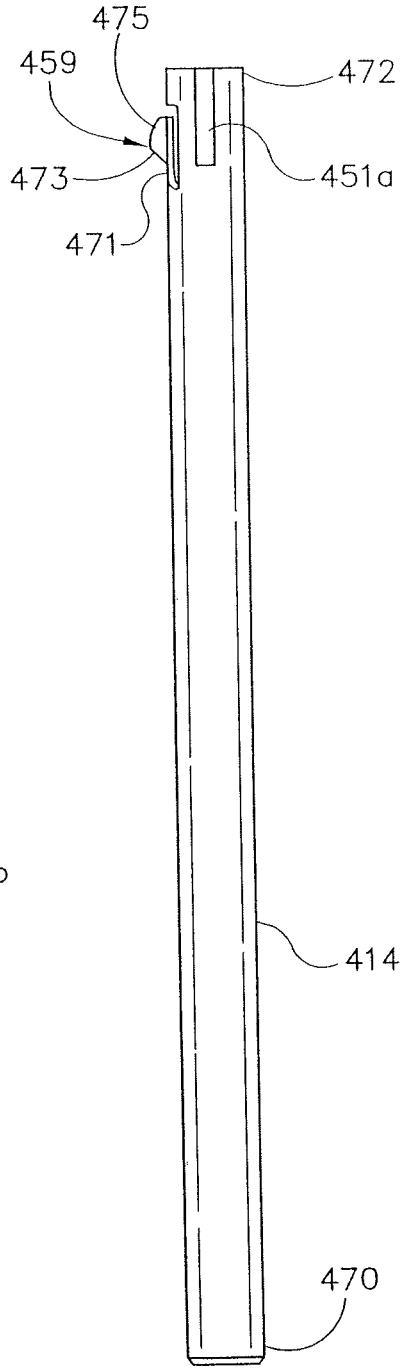
FIG. 45 is a side plan view of the second extension piece of the fourth embodiment of the present invention.

Slidably received within hollow cylindrical space 443 of the first extension piece 413 is the second extension piece 414. As illustrated in FIGS. 44-45, second extension piece 414 is a hollow member defining a generally trapezoidal inner space 461 axially inside of it. The hollow space 461 is dimensioned to slidably fit over the shank or I-beam 415. A pair of alignment tabs 451*a*, 451*b* is located on the outside surface of second extension piece 414 and is configured to slidably fit within longitudinal slots 449*a*, 449*b* of first extension piece 413. A rectangular spring receiving slot 493 is defined adjacent the forward end 470 of second extension piece 414 for receiving the head of a third retention leaf spring or engaging projection 467 integrally attached to the rearward end of the shank 415.

Figure 45A:
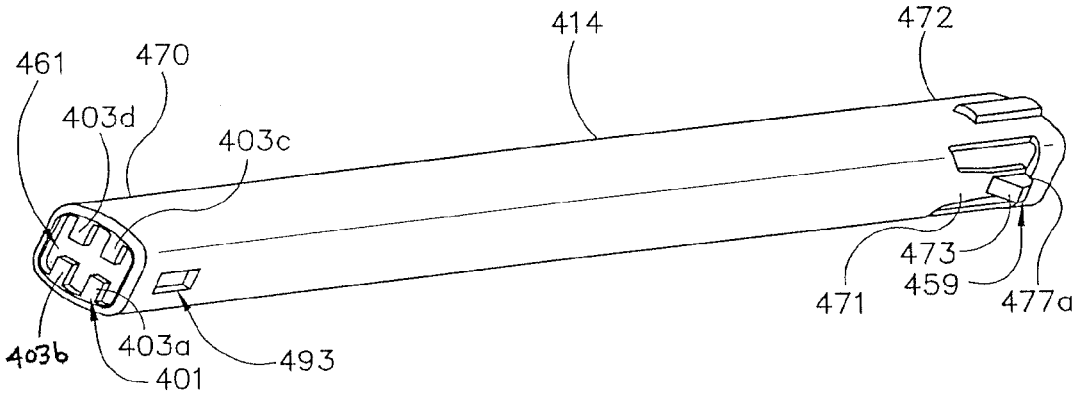
FIG. 45A is a perspective view of the second extension piece of the fourth embodiment of the present invention.

As illustrated in FIGS. 45 and 45A, the second spring or engaging projection 459 is similar to the first engaging projection 439. Second engaging projection 459 is integrally formed near the rearward end 472 of second extension piece 414. Second engaging projection 459 is also a cantilevered spring biased retaining member comprising a longitudinally extending base 471 and a spring biased head 473. Head 473 includes a rounded or angled upper surface 475 configured to fit within slot 491 of first extension piece 413. Head side edges 477*a*, 477*b* extend downwardly from the rounded or slanted head 473 and are configured to engage the edges of the slot 491 when extended therethrough in a locking position. The rounded or slanted head 473 of the engaging projection 459 allows the engaging projection 459 to be disengaged from the slot 491 by the sliding of the first extension piece 413 forward.

As best illustrated by FIGS. 44 and 45A, the forward end 470 of second extension piece 414 includes a slotted wall 401 configured to receive the outer surface defined by a solid or non-hollow shank or double I-beam 415. In the illustrated embodiment, slotted wall 401 is defined by four rectangular flanges 403*a-d*. Flanges 403*a-d* define a passage 405 for slidably receiving dopuble I-beam 415. It should be understood that the slotted wall 401 could take any of a variety of shapes depending on the shape of shank 415. As discussed below, it is preferred that shank 415 be a non hollow structure, to add rigidity and strength to the device. While an I-beam or double I-beam shape is preferred, it is understood that numerous other non-hollow structures, preferably ribbed structures, could be used for shank 415, including, but not limited to a solid rectangle, a V-shaped shank, and an L-shaped shank etc. and that the flanges 403*a-d* of slotted wall 401 would preferably define a passage 405 for receiving these alternative structures.

Figure 46A:
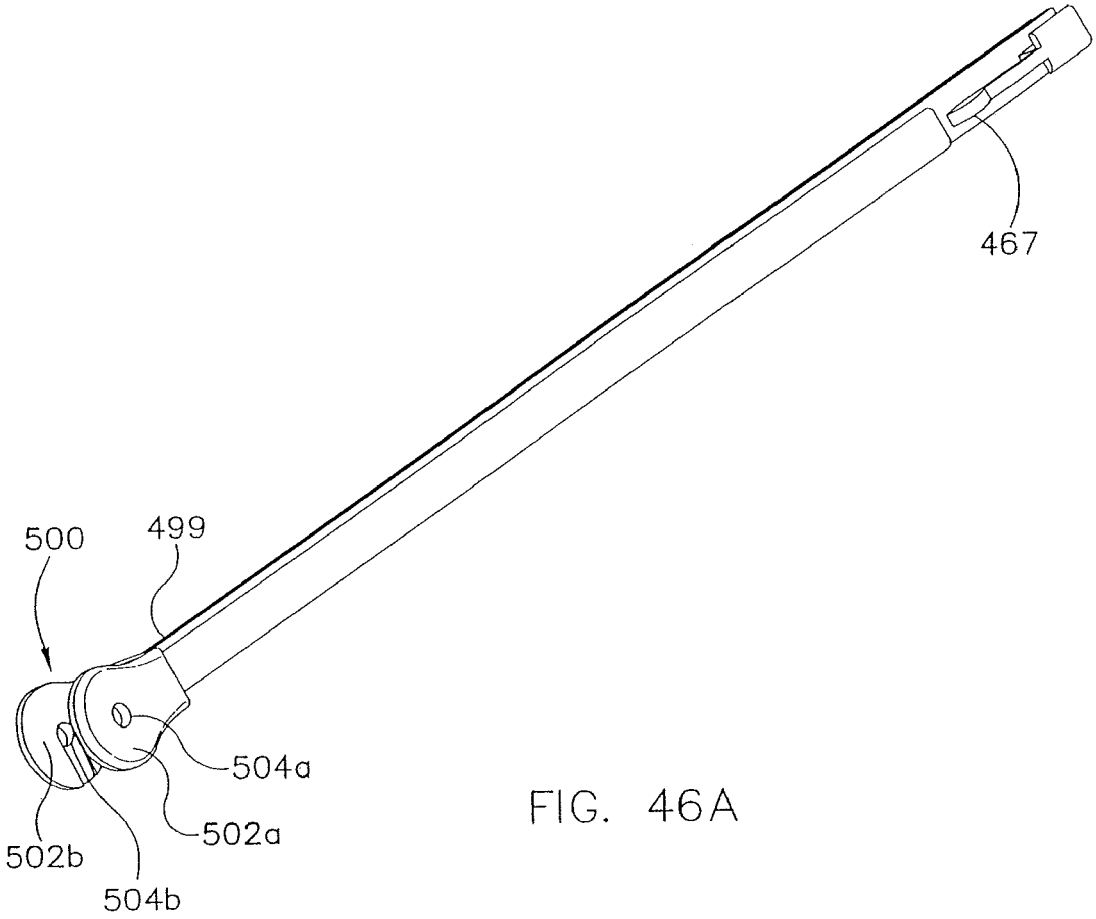
FIG. 46A is a perspective view of the shank of the fourth embodiment of the present invention.
Figure 46:
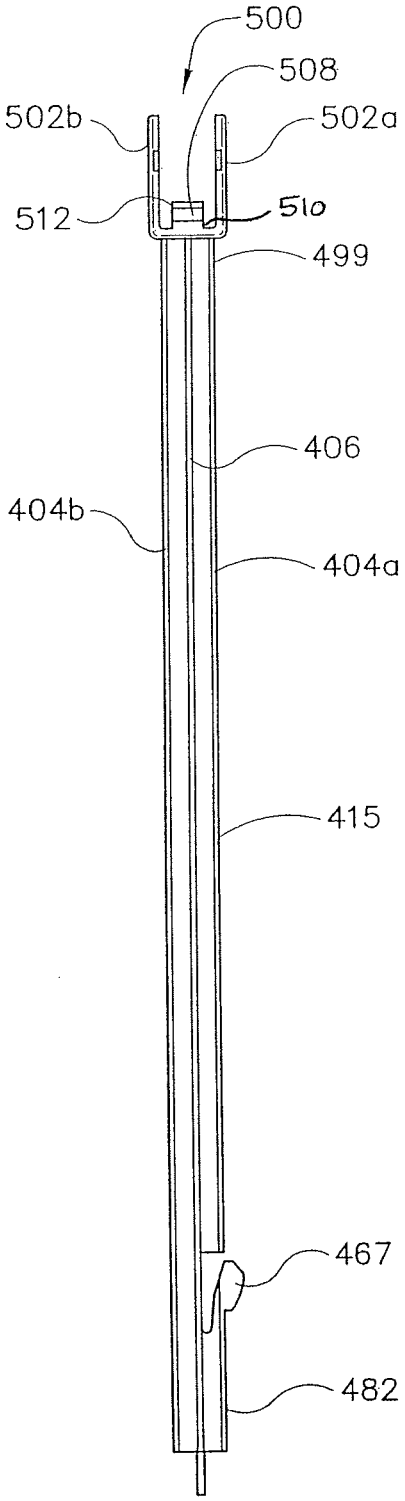
FIG. 46 is a side plan view of the shank of the fourth embodiment of the present invention.
Figure 47:
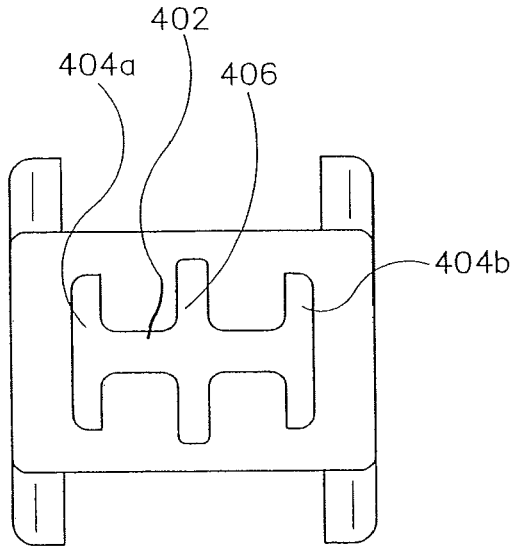
FIG. 47 is a bottom plan view of the shank of the fourth embodiment of the present invention.

Slidably received within hollow cylindrical space 461 of the second extension piece 414 is the non-hollow shank or double I-beam 415. As noted above, in the illustrated embodiment shank or double I-beam 415 is preferably a solid piece. I-beam 415 includes a base rib 402, outer ribs 404*a*, 404*b* extending perpendicularly to the outer edge of base rib 402 and a central rib 406 intersecting base rib 402 midway between the outer ribs 404*a*, 404*b* to define the I-beam shape. As illustrated in FIGS. 46 and 46A, I-beam 415 includes a third spring or engaging projection 467 similar to the first and second spring engaging projections. Third engaging projection 467 is integrally formed near the rearward end 482 of the I-beam 415. Third engaging projection 467 is also a cantilevered spring biased retaining member comprising a longitudinally extending base and a spring biased head as previously described. The third engaging projection 467 is configured to fit within slot 493 of second extension piece 414 in a manner previously described. The rounded or slanted head of the engaging projection 467 allows the engaging projection 467 to be disengaged from slot 493 by the sliding of the second extension piece 414 forward.

At the forward end 499 of the I-beam 415 is a pivot member receiving cavity 500. Pivot member receiving cavity 500 is defined between integral opposed ears 502*a*, 502*b* located at the forward end 499 of the I-beam 415. Ears 502*a*, 502*b* include pivot holes 504*a*, 504*b* configured to receive the axles 520*a*, 520*b* of the circular pivot members 522*a*, 522*b* of the primary 516 and secondary 518 support heads and allow pivotable motion therein.

Projecting upwardly from the pivot member receiving cavity 500 is a resiliently biased semi-flexible pivot engagement tab 508. Engagement tab 508 is comprised of a first end 510 attached to the base of the pivot member receiving cavity 500 and a second free end 512 configured to engage notches 532, 534 on the outer surface of the pivot member 520*a* of secondary support head 518. Preferably, notches 532, 534 are spaced about 180° apart. As a result, secondary support head 518 may be lockingly engaged to the pivot member receiving cavity 500 in either a storage position adjacent the telescoping support (FIG. 36) or in a position 180° from the storage position. Therefore the secondary support 518, and the attached primary support 516 may move freely between the two extremes as discussed below.

Figure 48:
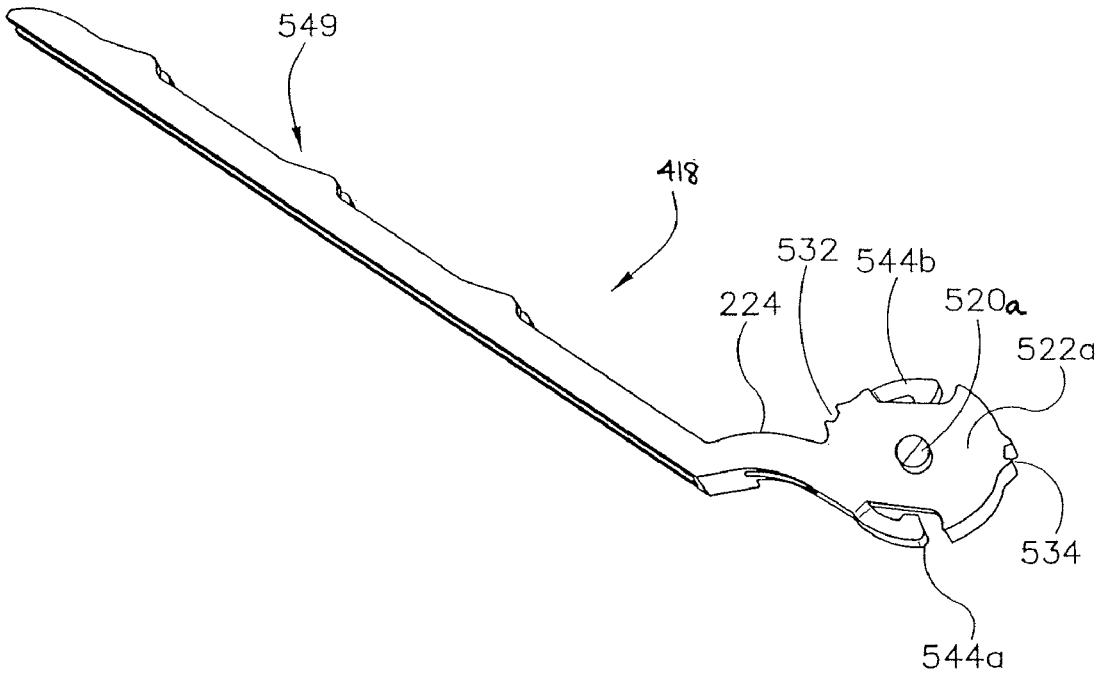
FIG. 48 is a perspective view of the secondary support of the fourth embodiment of the present invention.
Figure 49A:
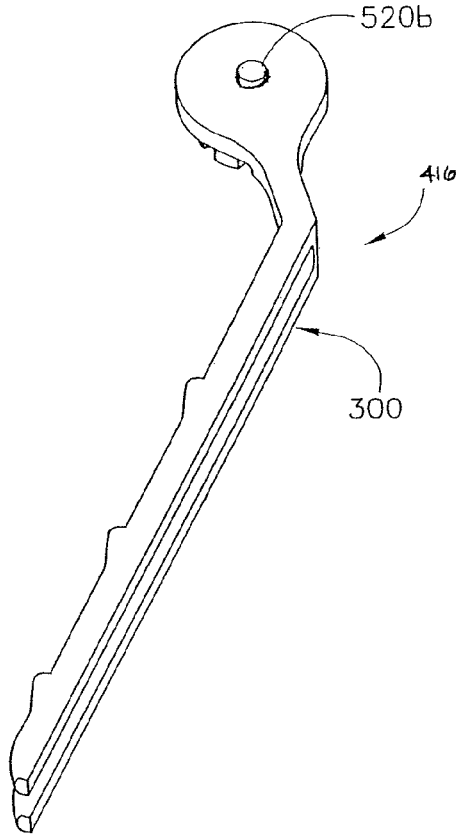
FIG. 49A is an alternative perspective view of the primary support of the fourth embodiment of the present invention.
Figure 48A:
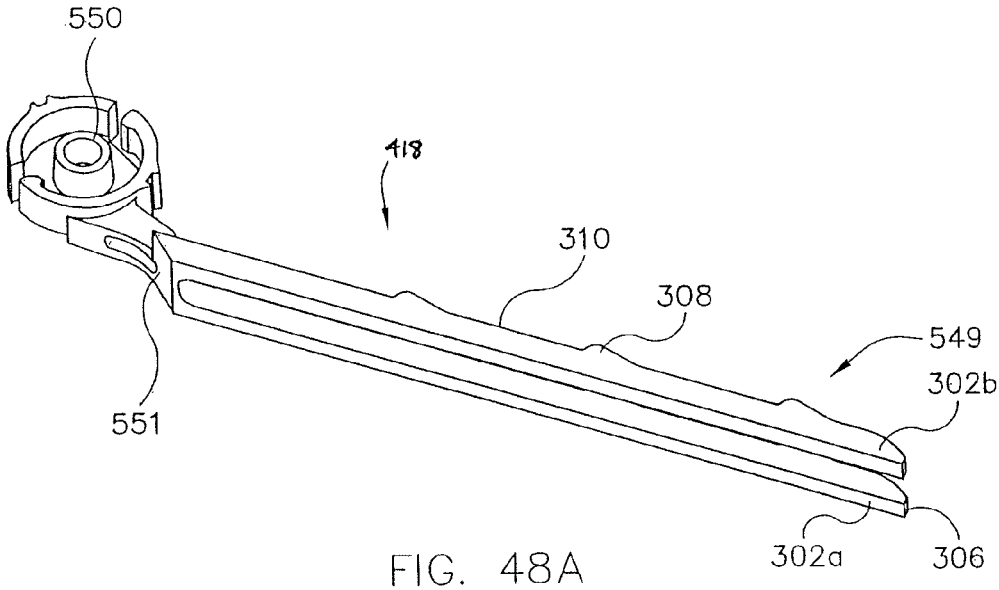
FIG. 48A is an alternative perspective view of the secondary support of the fourth embodiment of the present invention.
Figure 49:
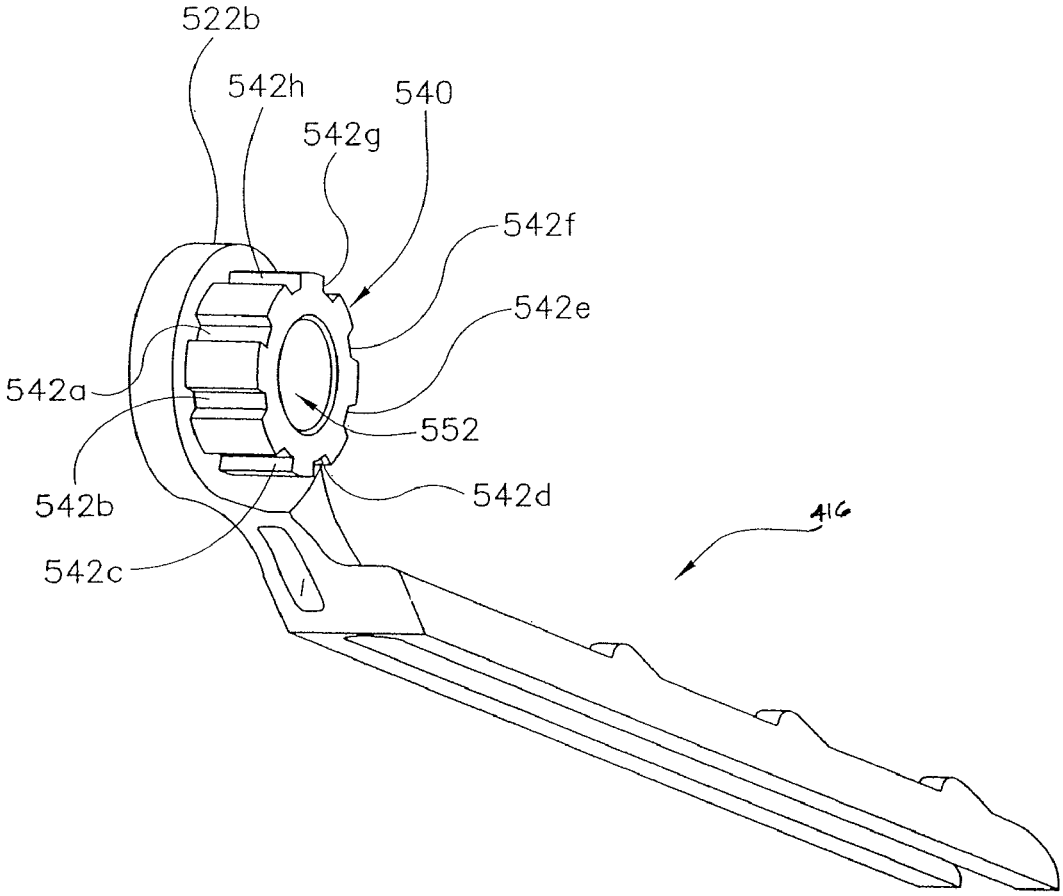
FIG. 49 is a perspective view of the primary support of the fourth embodiment of the present invention.

FIGS. 48-49A further illustrate the components of the primary 516 and secondary 518 support heads. As noted above primary 516 and secondary 518 support heads are pivotably received within the pivot member receiving cavity 500 of I-beam 415. As illustrated in FIG. 48A, primary support head 516 and secondary support head 518 are similar to those previously described and each include a support head 549 supported by a linking section 551 which connects to the circular pivot members 522*a*, 522*b*. In the preferred embodiment, support head 549 includes a pair of parallel attachment members, tines or attachment prongs 302*a*, 302*b* configured to engage the pockets or sleeves 304*a*, 304*b* of a cleaning pad 11 as is generally known in the art. Attachment members 302*a*, 302*b* may be spaced apart in a variety of configurations.

Attachment members 302*a*, 302*b* define a rounded leading edge 306 configured for ease of insertion into the sleeves 304*a*, 304*b* of cleaning pad 11. It is recognized that although the preferred embodiment illustrates a pair of attachment members 302*a*, 302*b* multiple configurations may be utilized. For example, a single, wider attachment member could be utilized. Alternatively, three or more attachment members could be utilized. Attachment members 302*a*, 302*b* include a plurality of spaced cleaning pad retaining tabs, barbs or projections 308 projecting from a first surface 310 as previously described.

Primary support head 516 and secondary support head 518 are selectively pivotably mounted within the pivot member receiving cavity 500. Both the primary 516 and secondary 518 support heads are lockingly adjustable relative to the other with a ratcheting type mechanism that retains the support heads in a desired position during normal dusting routines. As discussed below, the heads are also free to swivel relative to the telescoping support 409 of the cleaning tool 410, while remaining fixed relative to each other. Only at the extremes of their rotation are the support heads constrained relative to the telescoping support 409.

Primary support head 516 is illustrated in FIGS. 49 and 49A. Primary support head includes a cog 540 mounted to the inner surface of circular pivot member 522*b*. Cog 540 includes a plurality of grooves 542*a-h* configured to engage engagement tabs 544*a*, 544*b* on secondary support head 518 thereby locking primary 516 and secondary 518 support heads together in a variety of alternative configurations. It is preferred that the the primary support may be locked into a 45 degree, 90 degree, 135 degree, 180 degree, 225 degree and 270 degree position in relation to the telescopic support 409, however it is understood that it could be designed to lock into any number of positions. The engagement tabs 544*a*, 544*b* on secondary support head 518 are preferably spaced 180° degrees apart. It should be understood that although two engagement tabs 544*a*, 544*b* are illustrated, any number of engagement tabs could be utilized so long as they serve to selectively lock the primary and secondary support heads together. The number of grooves 542 determine the alternative orientations of the support heads 516, 518. While any number of grooves can be utilized, it is preferred that the primary and secondary heads be locked together in orientations at least 90° (FIG. 34) and 180° (FIG. 33) apart to accommodate preferred dusting orientations.

As illustrated in FIG. 48A secondary support head 518 includes a central hub 550. Hub 550 is configured to be received within a circular bore 552 located within the cog 540 on primary support head 516 thereby accommodating rotation of the primary 516 and secondary 518 support heads relative to one another.

Figure 32:
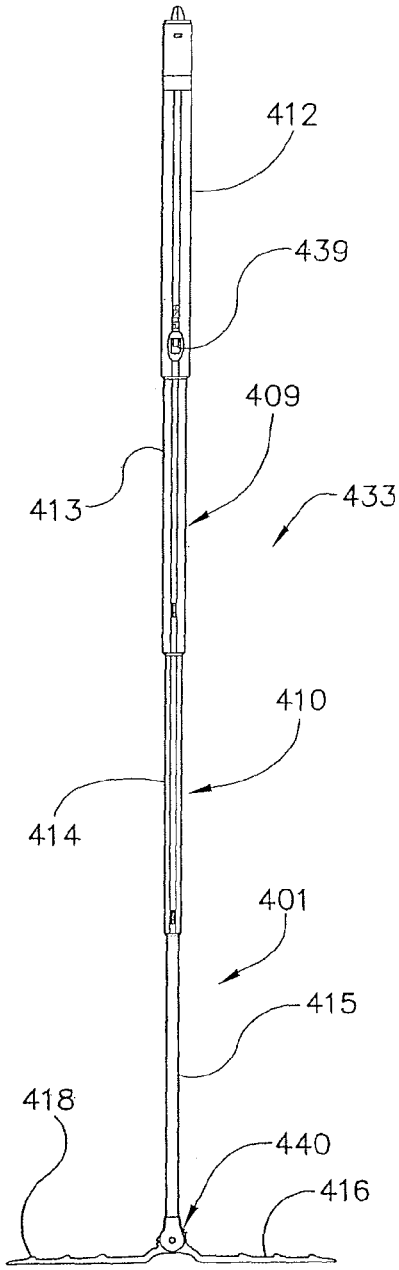
FIG. 32 is a front plan view of a fourth embodiment of the present invention in a fully extended state.
Figure 37:
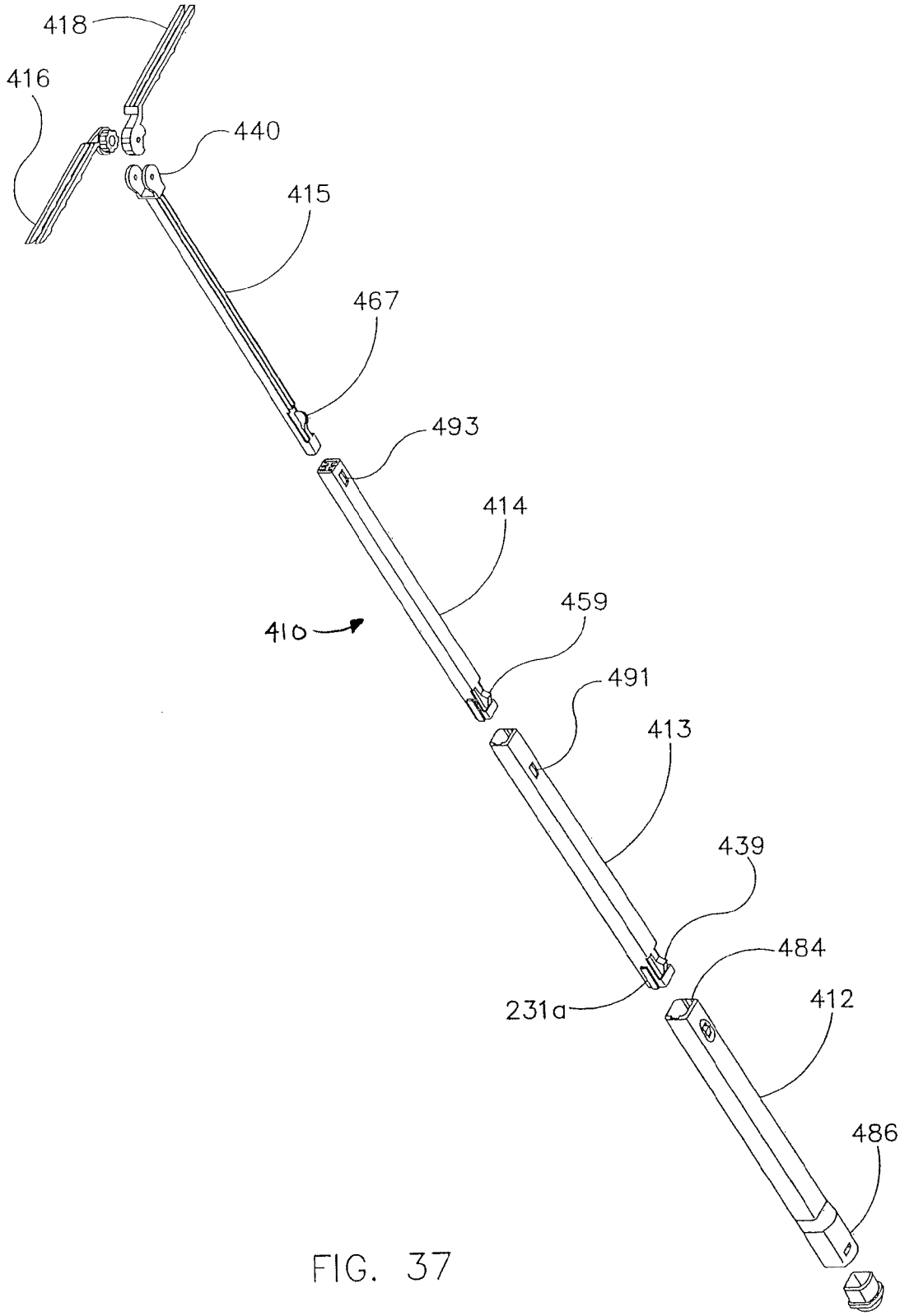
FIG. 37 is an exploded view of the components of the fourth embodiment of the present invention.

As apparent from the description and figures, the cleaning tool 410 may be used in both a short or collapsed configuration illustrated in for e.g. FIGS. 33-36 and a locked fully extended position 401 (FIG. 32). Use of the cleaning tool 410 in the short configuration is ideal for cleaning smaller areas such as shelves or small appliances with a single cleaning pad 11. Initiating with both the primary 416 and secondary 418 support heads in the folded storage position illustrated in FIG. 36, the primary support head 416 may be moved into one of four cleaning positions defined by the grooves 542*a-h* on cog 540.

As it can be appreciated from the discussion above, the components of the telescoping support 409 are similar to those previously discussed and allow the cleaning tool 410 to be extended from a maximum length of extension about 48 inches from a fully collapsed orientation of about 16 inches. The telescoping support 409 may be collapsed via the actuation of a single actuator, namely the first retention spring or engaging protection 439. Extension of the telescoping support 409 does not require the actuation of any of the engaging projections as discussed below.

The sequential extension of the telescoping support is similar to that described with reference to the previous embodiment. As the shank 415 is fully extended or pulled from the second extension piece 414, the third retention spring or engaging projection 467 attached to and extending through the shank 415 slides into the rectangular slot 493 on the second extension piece 414 thereby locking the fully extended shank 415 to the second extension piece 414. As one continues to pull on the shank 415, the attached second extension piece 414 slides through the first extension piece 413 until the second engaging projection 459 slides into the slot 491 on the first extension piece 413 thereby connecting the first extension piece 413 to the fully extended second extension piece 414 and shank 415. In a similar manner, as one continues to pull on the shank 415, the locked second extension piece 414 causes the first extension piece 413 to slide through the grip 412 until the first engaging projection 437 slides into the slot 435 on the grip 412 thereby locking the telescoping support 409 in its fully extended state, illustrated in FIG. 32.

It should be apparent from the above disclosure that the telescoping support 409 could be extended in an alternative manner, namely by extending the first extension 413 and slidably stored second extension piece 414 and shank 415 from the grip 412 and then extending the second extension piece 414 and slidably stored shank 415 from the first extension piece. Finally one could extend the shank 415 from the second extension piece 414 with the same results as described above. Each of the engaging projections will slide within the piece around it until it reaches and locks into its respective slot.

Due to the unique configuration of the telescoping support 409, the telescoping support 409 can be collapsed from its fully extended position illustrated in FIG. 32 by actuation or depression of a single engaging projection, namely first engaging projection 439 extending through slot 435 in grip 412. Actuation of engaging projection 439 allows grip 412 to be released and moved forwardly towards the shank 415. As the grip 412 moves forward, the inner surface of the grip 412 engages the second engaging projection 459 extending through the slot 491 on the first extension piece 413. Due to the rounded or angled head of the of the second engaging projection 459 the forward movement of grip 412 forces the second engaging projection 437 downward from the slot 491 thereby releasing the first extension piece 413. As the first extension piece 413 is moved forward, the inner surface engages the third engaging projection 467 extending through slot 493 on second extension piece 414. Similarly, the rounded head of the third engaging projection 467 allows the forward movement of the second extension piece 414 to force the third engaging projection 467 downward from the slot 493 thereby releasing the second extension piece 414. Second extension piece may then slide forward over the shank 415 to fully collapse the telescoping support 409.

Use of the cleaning tool 410 in the locked fully extended position 401 is ideally suited for cleaning larger surfaces such as floors and ceilings. In order to use the cleaning tool in the fully extended position 401, the telescopic support 409 is extended as previously described. A user then sets the primary support head 416. Preferably primary support head is set at a 180 degree position in relation to the handle to allow the heads 416, 418 to be in the same plane. Next, a user moves the secondary support head 418 to release secondary support head 418 from a fixed storage position. A cleaning pad can then be placed onto primary support head 416 and secondary support head 418. Once the secondary support head 418 is released from its locked position adjacent the shank 415, the angle between the primary support head 416 and secondary support head 418 is maintained, while the interlocked primary 416 and secondary 418 support head freely pivot. This freedom of motion is advantageous by allowing a user to freely slide the primary 416 and secondary 418 support heads across a surface to be cleaned from a variety of angles. Once the cleaning task is finished, the telescopic support 409 can be collapsed as previously described and the primary 416 and secondary 418 support heads can be returned to their storage position illustrated in FIG. 36.

Figure 27:
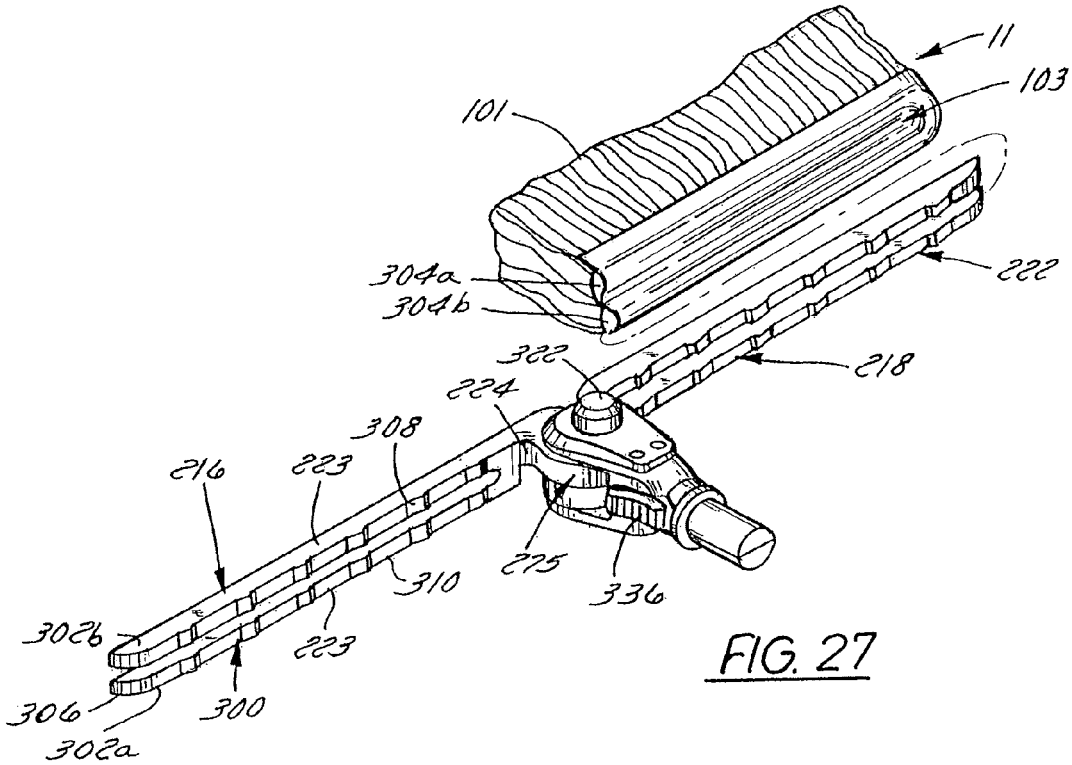
FIG. 27 is a partial perspective view of the forward mount of the third embodiment of the present invention.
Figure 28:
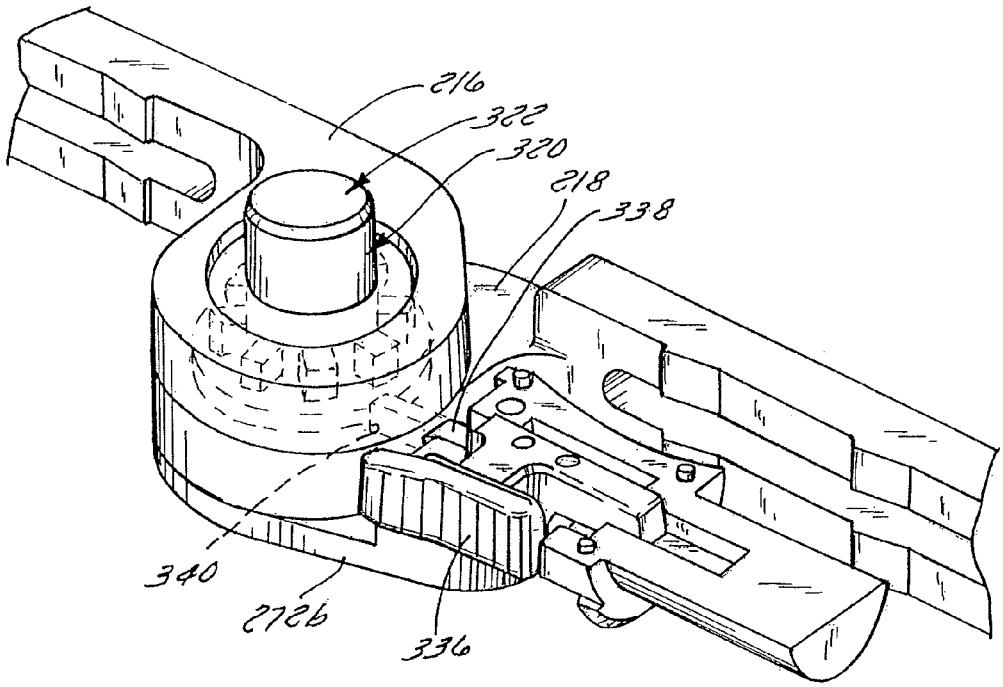
FIG. 28 is a partial perspective view of the forward mount of the third embodiment of the present invention.
Figure 29:
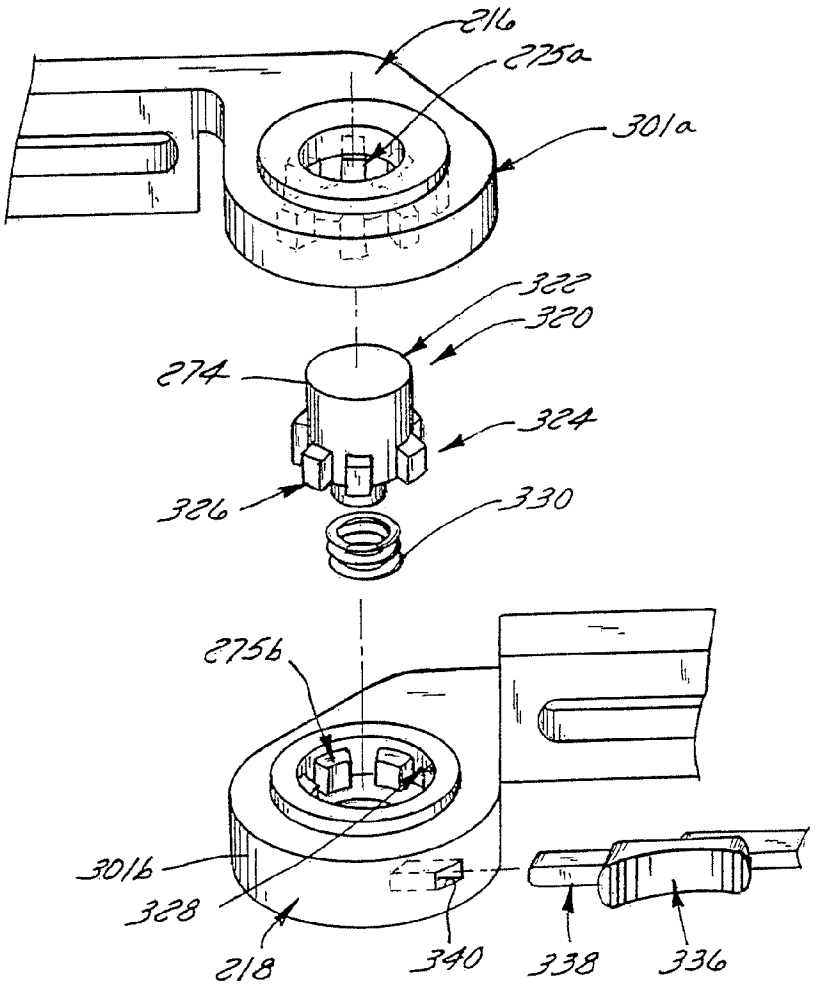
FIG. 29 is an exploded perspective view of the forward mount of the third embodiment of the present invention.

A wide variety of cleaning pads 11 could be used the inventive cleaning systems 33, 233. Cleaning pad 11 is generally known in the art and comprised of a combination of fibers defining a cleaning surface 101 and attachment portion 103 (FIG. 27). Preferred embodiments of cleaning pads capable of use with the inventive system are described in, for example, U.S. patent application Ser. No. 11/124,527 filed May 6, 2005, U.S. Pat. No. 6,968,591, PCT/JP2005/003571, PCT/JP2005/012867, PCT/JP2004/010507, PCT/JP2004/015916 and PCT JP/2003/001985 the disclosure of which are expressly incorporated by reference herein. The cleaning pad 11 may, for example, include a plurality of fluffed nonwoven fabrics made of synthetic resins, which may be welded to one another. The pad may include fibers constructed from PP, PE, PET fibers in a variety of alternative percentages by weight. In the illustrated embodiment, attachment portion 103 defines a pair of pockets or sleeves 304*a*, 304*b* configured to receive the attachment members 302*a*, 302*b*. Cleaning pad 11 is preferably, a 20 g/sqm spun lace cloth with between 1-4% mineral oil manufactured by Haso Corporation of Japan. Such cleaning or dusting pads are described in PCT/JP2004/10507 the entirety of which is expressly incorporated by reference.

When the cleaning system 33, 233 is used, the sleeve-like cleaning pad 11 is mounted over the attachment members 302*a*, 302*b* so that all of the retaining tabs 222 are within the sleeves 304*a*, 304*b*. The retaining tabs 222 are, in this configuration, thus capable of being fully enclosed by the cleaning pad 11, avoiding the possibility of the attachment members 302*a*, 302*b* scratching delicate furniture or other items being contacted.

The cleaning surface 101 of cleaning pad 11 may be comprised of a polymer that allows for the spontaneous transport of aqueous fluids. Such polymers are described in, for example, U.S. Pat. Nos. 5,723,159, 5,972,505 and 5,200,248 the disclosures of which are expressly incorporated by reference.

It should be recognized that the polymer fibers of the cleaning pad 11 can take a variety of forms to increase various performance characteristics of the cleaning systems 33, 233. Standard circular fibers may be used, as is generally known in the art. Alternatively, the individual fibers on the cleaning pad may be lobed in the form of loose "tow" fibers. The unique lobed configuration creates channels within the individual fibers enabling improved capillary action on each individual fiber and increasing the overall cleaning or dusting surface area thereby increasing the overall efficiency of both wet and dry dusting. The higher surface area results in an increase in the proportion of particles adhering in the grooves or channels and results in dust particles being "trapped" within the grooves of the lobed fiber. The lobed fibers generally exhibit improved dust retention, more efficient wet wiping and longer life than standard circular fibers. Furthermore, the lobed fibers can be made stiffer thereby generating a higher wiping pressure in a smaller contact area. It is understood that the inventive lobed fibers could be comprised of a multitude of polymers with PP, PE or PET being recognized as the most cost effective alternatives. Alternatively acrylic or biodegradable polymers could be utilized.

In another alternative embodiment, the cleaning pad 11 may include stiffer or strut fibers attached to mass of tow fibers. In this arrangement, the stiffer fibers (usually in the range of about 0.3 mm) carry the majority of the stress applied to the cleaning pad 11. The tow may be linked to the stronger fibers by entanglement at the outer ends of the fiber. The stiffer fibers result in a cleaning pad 11 that is springy resulting in a more desirable feel of applied force for users. The stiffer fibers can further be utilized to clean difficult areas such as crevices, blinds or screens. The stiffer fibers have the further advantage in that they keep the tow volume expanded, thereby increasing dust migration into the tow fibers.

In yet another alternative embodiment, the cleaning pad 11 could include absorbent materials in particulate form fixed onto the remaining fibers of the cleaning pad 11. The absorbent materials may take the form of known super absorbent polymers SAP. The SAPs may be, for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391 the disclosure of which is hereby expressly incorporated by reference.

The absorbent materials increase the overall absorbency of the fibers, prevent the fibers from packing close together into a fiber mass, and enhance the friction of the fibers. The "string of pearls" arrangement also allows for strategically placed high absorbency regions on the cleaning pad. For example, if it is desirable to have the forward end of the cleaning pad 11 be more absorbent than the remainder of the cleaning pad 11, the forward end could include a higher percentage of the particulate absorbent materials.

The cleaning pad 11 could also include fibers that are formed into helices. Such fibers can be formed by drawing fiber bundles over a blade or heating coaxial bicomponent fibers. The resulting helical fibers exhibit a fluffier texture and more attractive appearance while at the same time increasing the volume (while using less fiber) and dust retention of the duster. The helical nature of the fibers is also advantageous in that they allow coarse fibers to feel softer due to the spring effect. Furthermore, the fibers gradual loss of the helical nature, can serve as an indication of the effective life of the cleaning pad.

It should be recognized that none of the aforementioned fiber materials or configurations are exclusive. The cleaning pad could include strategic combinations of the various fibers and other known fibers. In one example, the cleaning pad may be comprised of between 25-100% of the lobed fibers by weight.

Similarly, although the preferred embodiment discloses a single cleaning surface 101, the invention is in no way limited to such a single cleaning surface. To the contrary, numerous alternative configurations are within the scope of the present invention. For example, the inventive pad could include multiple cleaning surfaces, with alternate or similar fiber configurations to accommodate various cleaning functions. In one embodiment, a cleaning pad 11 could be two sided with one side of the cloth for dusting and the alternate side of the cleaning pad 11 for cleaning. This could also be accomplished by turning the pad "inside out" to expose a new clean surface. Alternatively, a triangular or other multi-sided cleaning pad 11 could be utilized. Circular cleaning pads are also envisioned and within the scope of the present invention. In general, a variety of cleaning pad 11 shapes or configuration could be utilized to maximize the various properties of the cleaning pad 11 and selected fibers.

As noted above, the orientation and type of fibers utilized on the cleaning pad 11 could include a wide variety of alternatives. For example and in no way limiting, the cleaning pad 11 could include a generally fluffy pad including a flat center strip around the area defined by the pockets or sleeves 304*a*, 304*b*. Such an orientation may increase the surface area and exhibit a better efficacy. Additionally, the center strip could include an absorbent pillow or tube extending down the center of the cleaning pad 11. Such an absorbent pillow could provide an area of high absorbency on the cleaning pad 11. Various alternative combinations are envisioned including, for example, cleaning pads consisting of alternating sections of sponges, feather-like structures, micro-fibers or cellulose foam. Wood pulp is preferred.

The cleaning pad 11 could also include a fluffy cloth with a hydrophilic additive to improve the absorbency of water. Such hydrophilic additives include but are not limited to glycerin and glycols. The cleaning pad 11 could also be comprised entirely of an absorbent material such as rayon. The cleaning pad 11 could also have a fragrance added to improve the smell of the cleaning pad 11.

The cleaning pad 11 could also include a piezoelectric crystal to impart an electrostatic charge on the cleaning pad during use to increase dust retention. Such crystals are generally known and typically generate a charge when subjected to mechanical stress. Examples of materials that can be used include but are not limited to quartz analogue crystals like berlinite ($AlPO_4$) and gallium orthophosphate ($GaPO_4$), ceramics with perovskite or tungsten-bronze structures ($BaTiO_3$, $KNbO_3$, $LiNbO_3$, $LiTaO_3$, $BiFeO_3$, $Na_xWO_3$, $Ba_2NaNb_5O_5$, $Pb_2KNb_5O_{15}$). Additionally some Polymer materials like rubber, wool, hair, wood fiber, and silk exhibit piezoelectricity to some extent and may be utilized. Additionally, the polymer polyvinylidene fluoride, ($—CH_2—CF_2—$), which exhibits piezoelectricity several times larger than quartz may be used.

The cleaning pad 11 may also include a portion of an unbonded web material, as described in U.S. Pat. Nos. 5,858,515, issued Jan. 12, 1999 to Stokes et al. and 5,962,112, issued Oct. 5, 1999 to Haynes et al. or other material such as described by U.S. Pat. No. 4,720,415, issued Jan. 19, 1988 to Vander Wielan et al. or any super absorbent material such as described in U.S. Pat. Nos. 4,995,133, issued February 1991 and 5,638,569 both issued to Newell, 5,960,508, issued Oct. 5, 1999 to Holt et al., and 6,003,191, issued Dec. 21, 1999 to Sherry et al., all of which are hereby expressly incorporated by reference herein, in their entirety.

In one embodiment, the cleaning pad 11 may comprises a spunbond fiber nonwoven web having a basis weight of approximately 68 grams per square meter. The spunbond fibers may comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer or a polyester. About 1% or more or less of titanium oxide or dioxide is added to the fiber(s) in order to improve fiber opacity. The spunbond fiber nonwoven webs are thermally bonded with a point unbonded pattern. The nonwoven web is bonded using both heat and compacting pressure by feeding the nonwoven web through a nip formed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 28.

Alternatively, the pad 11 may comprise a laminate of an air-laid composite and a spunbond fiber nonwoven web. The nonwoven web may comprise monocomponent spunbond fibers of polypropylene having a basis weight of approximately 14 grams per square meter. The air-laid composite may comprises from about 85% to about 90% kraft pulp fluff and from about 10% to about 15% bicomponent staple fibers. The bicomponent staple fibers may have a sheath-core configuration; the core component comprising polyethylene terephthalate and the sheath component comprising polyethylene. The air-laid composite has a basis weight between about 200 and about 350 grams per square meter and an absorbency of between about 8 and about 11 grams per gram.

The cleaning pad 11 may also include a portion or side of hydrophilic fibers useful for scrubbing. Additionally, nylon fibers may be used to increase the coefficient of friction when they become wet. Portions of the cleaning pad 11 may be composed of microfibers and ultra-microfibers having a denier per filament (dpf) less than or equal to about 1.0.

As described, the cleaning pad 11 can be formed by any material or material-forming process known, including woven and non-woven materials, polymers, gels, extruded materials, laminates, layered materials which are bonded together integrally and thus form a co-material, fused materials, extruded materials, air laying, etc.

The cleaning pad 11 can alternatively be optimized for providing a cleaning fluid to the surface, such as with microcapsules or encapsulated fluids or agents. The enhanced surface of the cleaning pad 11 can have scrubbing or abrasive qualities. The enhanced surface can also be formed by a mechanical stamping, bonding, pressing, compression, extrusion, sprayed, sputtered, laminated or other surface forming or affecting process. The various alternative cleaning solutions discussed above could be microencapsulated into the cleaning pad such that they are selectively released by some additional stimulus. It is understood that various cleaning solutions microencapsulated into the cleaning pad could be activated by water, another chemical in the fluid reservoir or pressure. The solutions could be dry impregnated. Alternatively, the chemical solutions could be encapsulated in pockets or bubbles on or within the pad 11. The pockets could be designed to burst and release the cleaning solution upon the application of moderate pressure.

As noted above, a wide variety of fibers may be used in the cleaning pad 11 including cotton, wool and other natural fibers, polyethylene, polypropylene, polyethylene terephthalate, nylon, polyacrylic, polyesters, rayon and other synthetic fibers, core/sheath fibers, sea-island type fibers, side-by-side fibers and other composite fibers. Synthetic fibers and composite fibers are preferred due to their thermal welding properties. In one preferred embodiment, the tow is a bi-component fiber consisting of a core that has a higher melting point than the sheath. For example, in one embodiment the tow is a bi-component fiber consisting of a polypropylene core and a polyethylene outer surface or sheath. This is particularly preferred, because both materials have superior thermal welding properties. In addition, the fibers used for the cleaning pad 11 may be formed from a crimped material produced by mechanical crimping or thermal crimping.

In one preferred embodiment, the cleaning pad may be a long fiber mat generally referred to as "tow," which is manufactured from polyethylene, polypropylene, nylon, polyester, rayon, or similar materials. The thickness of the fibers that constitutes the fiber mat 203 is preferably between 1-18 denier. In addition, the weight of the fiber mat 203 is preferably between 5-30 g/m$^2$ when the thickness of the fibers is about 2 denier.

It is understood that the component parts of the inventive systems 33, 233 described above may be manufactured and sold separately or together in the form of a cleaning system or kit. It should be further understood the present invention contemplates a variety of additional alternative configurations and component parts which may be attached to the telescopic support. A wide variety of alternative interchangeable cleaning implements may be substituted for the primary and secondary supports 216, 218 described above. For example, and in no way limiting, an alternative cleaning implements could include a squeegee for cleaning windows, mirrors or other glass structures, a soft surface cleaner such as a lint roller, a glass cleaner including an indexing refill roll, an insect swatter, a dog brush or other grooming implement, a scrub brush, sponge, mop, paint brush, toilet brush or other cleaning implement etc. Numerous other cleaning implements are also within the scope of the present invention.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a cleaning system that includes a flexible support. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

We claim:

1. A cleaning tool comprising:

a telescoping support having at least two separate shafts, of which a hollow first shaft is configured to slidably receive a second ribbed shaft within the first shaft;

a primary support pivotably coupled to the second shaft and a secondary support pivotably coupled to the second shaft;

wherein the primary support and the secondary support are configured to receive at least one cleaning pad; and a first actuator operative to releasably lock the primary support at one of a first plurality of lockable positions and a second actuator operative to releasably lock the secondary support at one of a second plurality of lockable positions, and wherein the first actuator and the second actuator are independently operable to allow independent unlocking, pivoting, and locking of the primary support and the secondary support, respectively.

2. The cleaning tool of claim 1, wherein the first shaft comprises a slotted wall at a forward end, the slotted wall configured to receive the second ribbed shaft.

3. The cleaning tool of claim 1, wherein the second shaft is an I-beam.

4. The cleaning tool of claim 1, wherein a terminal end of the second ribbed shaft has a cavity, and wherein the primary support has a first cog and the secondary support has a second cog, wherein the cogs are configured to be received in the cavity and secured to the terminal end of the second shaft in a manner that allows rotation of the cogs within the cavity.

5. The cleaning tool of claim 4, further comprising a catch positioned in the terminal end of the second shaft and adapted to engage at least one of the first cog and the second cog to lock the cogs at a desired position.

6. The cleaning tool of claim 1, wherein the at least two separate shafts are releasably locked together by at least one spring biased engaging projection extending from the second shaft into a slot on the first shaft.

7. The cleaning tool of claim 1, wherein the at least two separate shafts comprise a grip, a first extension piece, a second extension piece and a shank slidably received within one another;

wherein the grip defines a hollow space configured to receive the first extension piece, the first extension piece defines a hollow space configured to receive the second extension piece and the second extension piece defines a hollow space configured to receive the shank; and wherein the grip, first extension piece, second extension piece and shank freely slide into a locked fully extended position and wherein the grip, first extension piece, second extension piece and shank may be collapsed from the locked fully extended position by the depression of a single engaging projection.

8. The cleaning tool of claim 7, further comprising at least one alignment tab extending along an outside surface of first extension piece and configured to be received in a slot in the grip and at least one alignment tab extending along an outside surface of second extension piece and configured to be received in a slot in the first extension piece.

9. The cleaning tool of claim 1 wherein the first set of lockable positions includes at least a first position and a second position, wherein the first position results in the primary support shaft being folded adjacent a first length of the second shaft and the second position results in the primary support shaft being oriented substantially perpendicular to the length of the second shaft, and wherein the second set of lockable positions includes at least a third position and a fourth position, wherein the third position results in the secondary support shaft being folded adjacent a second length of the second shaft and the fourth position results in the secondary support shaft being oriented substantially perpendicular to the length of the second shaft, and wherein the first and the third positions are defined along opposite lateral sides of the second shaft and when the primary and the secondary support are positioned at the second and fourth positions, respectively, the primary and the secondary supports are generally aligned with one another.

10. A holding device comprising;

a telescopic support comprising a plurality of slidable shafts;

a primary support and a secondary support rotatably mounted to one of the slidable shafts, each support configured to retain a cleaning pad;

a button mounted at a terminal end of the one shaft and operative to release the primary support from locked engagement with the one shaft to allow the primary support to be rotated relative to the one shaft to a desired position;

a slider mounted approximate the terminal end of the shaft and operative to release the secondary support from locked engagement with the one shaft to allow the secondary support to be rotated relative to the one shaft to a desired position; and wherein the button and the slider can be independently actuated to allow independent unlocking and movement of the primary and the secondary supports.

11. The holding device of claim 10, wherein the primary support can be rotated at least 225 degrees in relation to the telescopic support.

12. The holding device of claim 10, wherein the primary support can be locked into a 45 degree, 90 degree, 135 degree, 180 degree, 225 degree, and 270 degree position in relation to the telescopic support.

13. The holding device of claim 10, wherein the secondary support can be rotated at least 180 degrees in relation to the telescopic support.

14. The holding device of claim 10, wherein the primary and the secondary supports each have a cog that is secured within a cavity formed at the terminal end of the one shaft in a manner that allows independent rotation of the cogs, and further comprising an engagement tab formed at the terminal end of the one shaft and configured to releasably engage at least one of the cogs to lock the at least one the cogs at a desired rotated position.

15. The holding device of claim 10, wherein the one shaft is a ribbed shaped shaft.

16. The holding device of claim 15, wherein the ribbed shaped shaft is an I-beam and at least one of the plurality of shafts comprises flanges for slidably receiving the I-beam.

17. The holding device of claim 10, wherein the plurality of slidable shafts freely move into a locked fully extended position, wherein the locked fully extended position maintained by a plurality of engaging projections extending from the plurality of shafts into a plurality of slots on alternate shafts and wherein the slidable shafts may be collapsed from the locked fully extended position by the depression of one of the plurality of engaging projections.

18. A holding device comprising:

a telescopic support comprising a plurality of slidable shafts;

a primary support and a secondary support rotatably mounted to one of the slidable shafts, each support configured to retain a cleaning pad;

a button mounted at a terminal end of the one shaft and operative to release the primary support from locked engagement with the one shaft to allow the primary support to be rotated relative to the one shaft and locked at one of a first plurality of positions;

a slider mounted approximate the terminal end of the shaft and operative to release the secondary support from locked engagement with the one shaft to allow the secondary support to be rotated relative to the one shaft and locked at one of a second plurality of positions, wherein the button and the slider can be independently actuated to allow independent unlocking and movement of the primary and the secondary supports; and wherein the first plurality of positions includes at least a first position and a second position, wherein the first position results in the primary support being folded adjacent a first length of the one shaft and the second position results in the primary support being oriented substantially perpendicular to the length of the one shaft, and wherein the second plurality of positions includes at least a third position and a fourth position, wherein the third position results in the secondary support being folded adjacent a second length of the one shaft and the fourth position results in the secondary support being oriented substantially perpendicular to the length of the one shaft, and wherein the first and the third positions are defined along opposite lateral sides of the one shaft, and when the primary and the secondary support are positioned at the second and fourth positions, respectively, the primary and the secondary supports are generally aligned with one another.

* * * * *